US005519483A

United States Patent [19]

Kawanishi et al.

[11] Patent Number: 5,519,483

[45] Date of Patent: May 21, 1996

[54] DETECTION SYSTEM AND DETECTION METHOD OF DOCUMENT SIZE FOR USE IN A DOCUMENT READER

[75] Inventors: Shinya Kawanishi, Tenri; Kouichi Furuta; Keiichi Okada, both of Nara, all of Japan

[73] Assignee: Sharp Kabushiki Kaisha, Osaka, Japan

[21] Appl. No.: 88,682

[22] Filed: Jul. 9, 1993

[30] Foreign Application Priority Data

| | | | |
|---|---|---|---|
| Jul. 10, 1992 | [JP] | Japan | 4-183489 |
| Oct. 30, 1992 | [JP] | Japan | 4-292452 |
| Dec. 4, 1992 | [JP] | Japan | 4-325480 |
| Jan. 12, 1993 | [JP] | Japan | 5-003160 |

[51] Int. Cl.[6] ..... G03G 21/00

[52] U.S. Cl. ..... 355/311; 355/75; 358/474

[58] Field of Search ..... 355/75, 311; 358/474

[56] References Cited

U.S. PATENT DOCUMENTS

| | | | |
|---|---|---|---|
| 4,511,246 | 4/1985 | Nishiyama | 355/75 |
| 4,541,713 | 9/1985 | Maekawa | 355/75 |
| 4,568,181 | 2/1986 | Nishiyama | 355/75 |
| 4,585,332 | 4/1986 | Shenoy | 355/311 X |
| 4,614,874 | 9/1986 | Fukuda et al. | 355/75 X |
| 4,659,214 | 4/1987 | Takemura et al. | 355/75 |
| 4,713,550 | 12/1987 | Anzai et al. | 355/75 X |
| 4,771,338 | 9/1988 | Fujiwara | 358/474 |
| 4,939,377 | 7/1990 | Okuda et al. | 250/560 |
| 4,954,846 | 9/1990 | Matsuo et al. | 355/311 |

FOREIGN PATENT DOCUMENTS

| | | |
|---|---|---|
| 61-252653 | 11/1986 | Japan . |
| 62-006105 | 1/1987 | Japan . |
| 62-142287 | 6/1987 | Japan . |
| 2-195338 | 8/1990 | Japan . |
| 2-240508 | 9/1990 | Japan . |
| 3-175306 | 7/1991 | Japan . |

*Primary Examiner*—Fred L. Braun

[57] ABSTRACT

A light-emitting elements emits a light beam onto a predetermined sensing position, and a reflected beam from an original is received by a light-receiving element. The light-receiving element, which is a position sensitive detector for detecting a spot position of the reflected beam, releases a pair of currents that vary according to the spot position. A signal processing circuit detects the presence or absence of the original based on the ratio of the currents. The pair of currents released by the light-receiving element fluctuate in response to changes in reflection factor due to the individual color of the original, while the ratio of the pair of currents does not fluctuate even if the reflection factor changes. Thus, detection accuracy is improved, and erroneous detection can be prevented in comparison with an arrangement wherein the presence or absence of the original is detected by detecting and comparing the amount of light.

42 Claims, 22 Drawing Sheets

DETECTION SYSTEM AND DETECTION METHOD OF DOCUMENT SIZE FOR USE IN A DOCUMENT READER

FIELD OF THE INVENTION

The present invention relates to a document-size detection system of a document reader for use in a copying machine, an image reader of a computer, or other apparatuses.

BACKGROUND OF THE INVENTION

FIG. 26 shows a schematic view of a conventional document-size detection system using a detection method based on the amount of reflected light.

Conventionally, a sensor which detects the amount of reflected light has been used as a document size sensor for use in the document reader of copying machines. In the sensor of this type, which uses the detection method based on the amount of reflected light, a light-emitting element 81 such as an infrared light-emitting diode (LED) and a light-receiving element 82 such as a phototransistor are installed below a transparent glass plate 83 (document platen) whereon an original 84 is placed.

When there is no original 84 on the glass plate 83, a light beam emitted from the light-emitting element 81 is separated into two beams, one reflected off the glass plate 83 and the other passing through the glass plate 83. Only the beam reflected off the glass plate 83 is incident to the light-receiving element 82. In this case, the amount of light that is incident to the light-receiving element 82 is comparatively small.

In contrast, when there is an original 84 on the glass plate 83, the beam that passes through the glass plate 83 is reflected off the original 84; therefore, both of the beams reflected off the glass plate 83 and reflected off the original 84 are incident to the light-receiving element 82. In this case, the amount of light that enters the light-receiving element 82 is comparatively large.

As described above, when the amount of reflected light is large, detection is made with the result that "the original 84, as a reflective object, is present" at the sensing position of the sensor. When the amount of reflected light is small, detection is made with the result that "the original 84 is absent" at the sensing position of the sensor. Conventionally, a plurality of such sensors detecting the amount of reflected light are installed, and by detecting the presence and absence of the original 84 at the respective sensing positions, the size of the original 84 is detected.

Therefore, when the original 84 that is placed on the document platen 83 is whitish, that is, when the color of the document 84 has a high reflection factor, the amount of reflected light received by the light-receiving element 82 increases to a great degree, thereby providing an easy detection.

However, in the case when the original 84 is dark-colored like that obtained by copying a photograph, that is, when the color of the document 84 has a low reflection factor, the amount of reflected light received by the light-receiving element 82 does not increase so much. For this reason, the sensor tends to make an erroneous detection that "the original 84 is absent" in spite of the fact that the original 84 is present.

Further, in the event of deterioration of the LED due to long-time use or an insufficient amount of light in the LED due to changes in ambient temperature, the erroneous detection of the size of the original 84 might occur more frequently with respect to a dark-colored original 84. In these cases, even if an original 84 with a reflection factor that is not so low is used, the erroneous detection of the size of the original 84 might occur.

Moreover, as illustrated in FIG. 27, in the conventionally used sensor wherein the detection method based on the amount of light is employed, the same number of sensors (six in FIG. 27) as that of types of document sizes to be detected and identified is required. (Here, the types of document sizes are six: A3, A4, A4R , B4, B5, and B5R according to Japanese Industrial Standard [JIS].) For example, if number (1) through number (4) sensors detect "the presence of the original" while number (5) and (6) sensors detect "the absence of the original", the detection is made with the result that "the size of the original is A4R". This arrangement has required a large number of sensors, that is, a large number of the light-emitting elements 81 and the light-receiving elements 82, depending on the number of sensing positions. Such a large number of units result in an increase in cost and complicated installation work, and those members such as fixing members are also required for each unit, thereby causing adverse effects in space saving of the document reader.

SUMMARY OF THE INVENTION

It is the first objective of the present invention to provide a document-size detection system for accurately detecting the size of an original regardless of the variation of reflection factor due to the individual color of the original or other causes.

Moreover, it is the second objective of the present invention to provide a document-size detection system wherein cost reduction, simplification of installation work and space saving in a document reader are achieved by reducing the number of parts.

In order to achieve the first objective, the document-size detection system for use in a document reader according to the present invention is provided with at least the following means:

(1) light-emitting means for projecting a light beam onto a predetermined sensing position on a document platen;

(2) light-receiving means for receiving a reflected beam derived from the light beam reflected off the sensing position and for releasing a plurality of detection signals that correlatively vary depending on a light-receipt position of the reflected beam on the light-receiving means; and (3) signal processing means for detecting the presence or absence of an original at the sensing position according to a ratio of the detection signals.

With the above arrangement, the light-emitting means projects a light beam onto a predetermined sensing position on the document platen, and the light-receiving means receives a reflected beam from the sensing position. The light-receipt position of the reflected beam on the light-receiving means varies depending on which position the light beam, which is projected from the light-emitting means, is reflected off, and the light-receiving means releases the detection signals that correlatively vary depending on the light-receipt position of the reflected beam. Although the detection signals vary in response to changes in the amount of reflected light from the original, the ratio of the detection signals is independent of the changes in the amount of reflected light, and is determined by the light-receipt position of the reflected beam on the light-receiving means.

Therefore, since the signal processing means detects the presence or absence of the original at the sensing position according to the ratio of the detection signals that are independent of the changes in the amount of reflected light, the presence or absence of the original is detected more accurately even in the case of detecting an original that has a color having a low reflection factor in comparison with an arrangement wherein the presence or absence of the original is detected merely by comparison of the amount of reflected light. Thus, based on the detection result made as to the presence or absence of the original at the sensing position, the size of an original is detected accurately.

Further, in order to achieve the second objective, the document-size detection system of the present invention is provided with at least the following means:

(1) light-emitting means for projecting a light beam onto a sensing region that is separated by a peripheral edge of an original having a predetermined size on a document platen;

(2) light-receiving means for receiving a reflected beam derived from the light beam reflected off the sensing region and for detecting a light-receipt position of the reflected beam on the light-receiving means; and (3) signal processing means for comparing the output of the light-receiving means with the reference data including the reference datum associated with reflected light from the original corresponding to the entire area of the sensing region, that associated with reflected light from the original corresponding to a part of the area and that associated with no reflected light, so as to detect a placed state of the original at the sensing region.

With the above arrangement, the sensing region, whereto the light beam from the light-emitting means is projected, is divided by the peripheral edge of an original having a predetermined size on the document platen, thereby giving the three states in the sensing region according to the size of the original placed thereon: a state wherein the entire area of the sensing region is occupied by the original, a state wherein a part of the sensing region is occupied by the original, and a state wherein no sensing region is occupied by the original. In accordance with these three states, at least three cases are presented as to the reflected beam: a reflected beam from the original is obtained from the entire area of the sensing region, a reflected beam from the original is obtained from a part of the area of the sensing region, and no reflected beam from the original is obtained from the sensing region. Accordingly, the light-receipt position of the reflected beam on the light-receiving means varies at least in three ways.

Therefore, the signal processing means detects the placed state of the original at the sensing region by comparing an output of the light-receiving means with the reference data. This arrangement, wherein a plurality of states are detected by using one sensing region, makes it possible to eliminate the necessity of installing as many sensing regions as the number of the sizes of the original to be identified. Thus, since the number of light-emitting means and light-receiving means to be installed can be reduced, the number of parts is reduced, thereby making it possible to reduce cost, to simplify the installation work, and to save space.

Moreover, in order to achieve the second objective, another document-size detection system of the present invention is provided with at least the following means:

(1) light-emitting means for projecting a light beam onto a predetermined sensing position on a document platen;

(2) light-receiving means whose viewing angle is set so as to receive a plurality of reflected beams, each derived from the light beam that has been reflected off each of a plurality of sensing positions, and which detects a light-receipt position of the reflected beam on the light-receiving means; and (3) signal processing means for detecting the presence or absence of an original according to outputs from the light-receiving means.

With the above arrangement, the viewing angle of the light-receiving means is set so as to receive the reflected beams from those sensing positions. Since the light-receipt positions on the light-receiving means derived from the reflected beams that have been reflected off the respective sensing positions are different from one another depending on the respective sensing positions, the signal processing means can identify which sensing position the particular received light has been reflected off based on outputs from the light-receiving means for detecting the light-receipt positions of the reflected beams.

Therefore, this arrangement eliminates the necessity of providing the same number of the light-receiving means as that of the sensing positions that would be installed so as to deal with the respective sensing positions. Since the number of the light-receiving means to be installed can be reduced, the number of parts is reduced, thereby making it possible to reduce cost, to simplify the installation work and to save space.

Furthermore, another document-size detection system of the present invention is provided with at least the following means in order to achieve high accuracy in detection without taking account of variations in the amount of light emission, the light-receiving sensitivity or other factors.

(1) a material having a light-scattering property that is affixed on the lower surface of an original cover that is freely opened and closed with respect to a document platen;

(2) a size sensor for projecting a light beam onto a predetermined sensing position on the document platen and receiving a reflected beam derived from the light beam that has been reflected off the sensing position, and for detecting a light-receipt position of the reflected beam on the size sensor; and (3) size decision means for detecting the presence or absence of an original at the sensing position and identifying the size of the original by comparing a resulting measurement, which is released by the size sensor with the original placed on the document platen, with the reference datum in the presence of the original and for updating the reference datum in the presence of the original at a desired timing in accordance with an output released from the size sensor upon receipt of a reflected beam from the material having the light-scattering property with the original cover closed.

With the above arrangement, the size decision means readily updates the reference datum in the presence of the original by the use of the material having the light-scattering property by activating the size sensor with the original cover closed, at a desired timing such as a timing which is synchronized by the activation of the document reader or if occasion demands when erroneous detection of the document size frequently occurs due to changes in environmental conditions or the like. Therefore, in contrast to the case where the resulting measurement is compared with the absolute reference datum so as to detect the presence or absence of the original, the detection accuracy is improved, and it becomes possible to eliminate the necessity of taking account of variations in the amount of light emission, the light-receiving sensitivity or other factors.

Moreover, another document-size detection system of the present invention is provided with at least the following means, and those means make it possible to set an optimum threshold level for each of a plurality of sensing positions on the document platen, thereby further improving the detection accuracy.

(1) a size sensor for projecting a light beam onto a predetermined sensing position on a document platen and receiving a reflected beam derived from the light beam that has been reflected off the sensing position, and for detecting a light-receipt position of the reflected beam on the size sensor; and (2) size decision means for detecting the presence or absence of an original at each of the sensing positions and identifying the size of the original by comparing each resulting measurement, which is released by each of the size sensors associated with the respective sensing positions with the original placed on the document platen, with the reference datum in the presence of the original and the reference datum in the absence of the original that are set for each of the sensing positions.

With the above arrangements, the reference datum in the presence of the original and the reference datum in the absence of the original are set for each of the sensing positions, and each resulting measurement at each of the sensing positions is compared with the reference datum in the presence of the original and the reference datum in the absence of the original for each of the sensing positions. If there is no original placed on the document platen, the positions from which light beams from the size sensors are reflected off are different depending on the respective sensing positions; therefore, the levels of resulting measurements in the respective size sensors inevitably have variations depending on the respective sensing positions. Therefore, if a constant threshold level is set for dealing with all the sensing positions in order to detect the presence or absence of the original, erroneous detection might be caused more frequently.

As described above, by setting the reference datum in the presence of the original and the reference datum in the absence of the original for each of the sensing positions, an optimum threshold level is set for each of the sensing positions. Thus, by comparing the resulting measurements with the reference datum in the presence of the original and the reference datum in the absence of the original, detection of the size of an original can be conducted more accurately.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a drawing showing a distribution of resistivity on a surface resistive layer of the light-receiving element.

DESCRIPTION OF THE EMBODIMENTS

[EMBODIMENT 1]

Referring to FIGS. 1 through 11, the following description will discuss one embodiment of the present invention.

Figure 1:
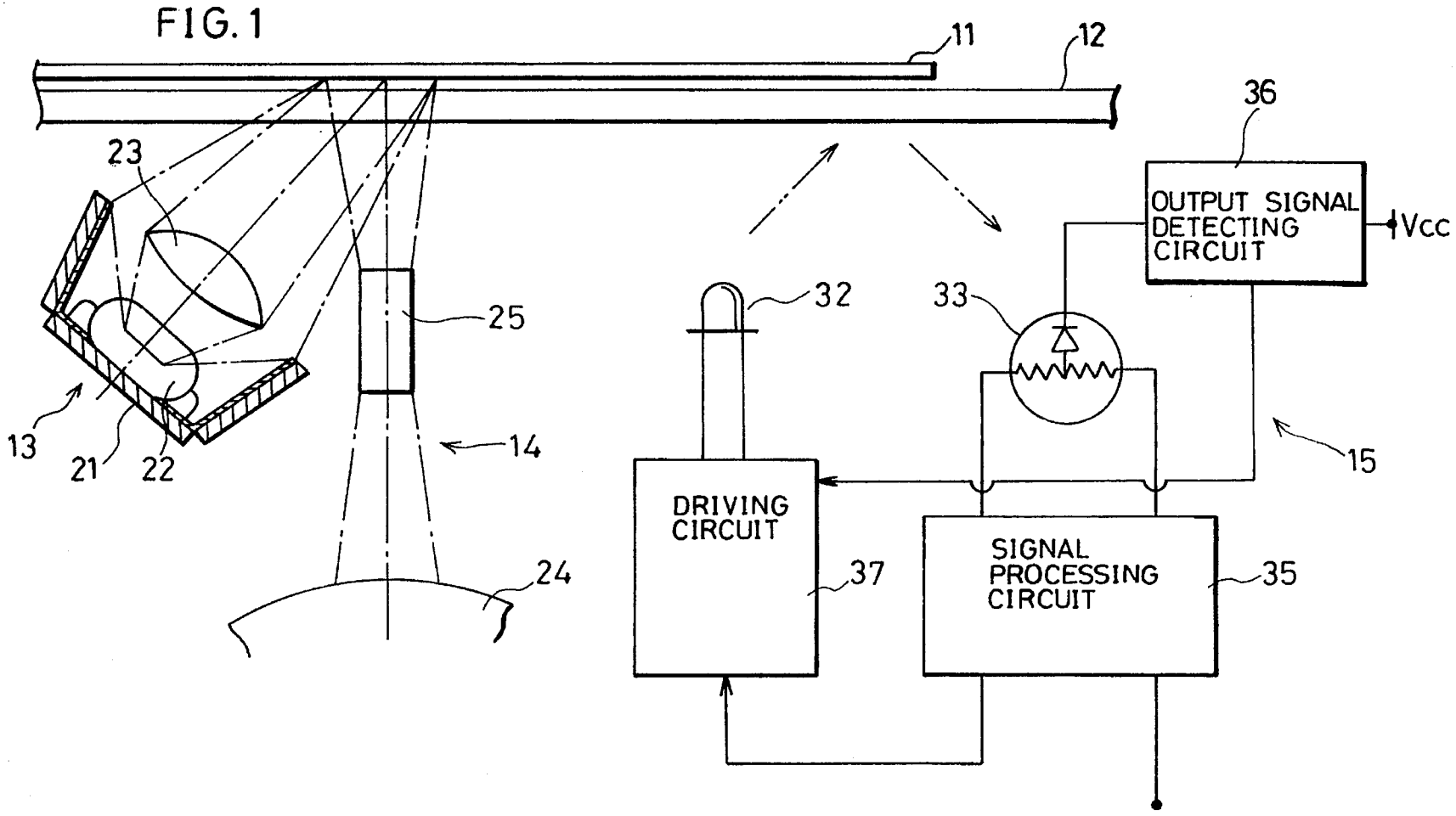
FIG. 1 is a schematic sectional side view showing one example of a document-size detection system of a document reader in accordance with the present invention.

FIG. 1 shows one structural example of a document reader wherein a document-size detection system of the present embodiment is installed. The document reader, which is used in a common copying machine, is constituted of a document platen 12 whereon an original 11 is placed, an exposure section 13 for exposing the original 11 on the document platen 12, an optical system 14 for reading a beam that is reflected off the original 11 on the document platen 12 after having been projected from the exposure section 13 onto the original 11, and size sensors 15 that are installed as a document-size detection system for detecting the size of the original 11.

In the same conventional manner, the document platen 12 is made of a transparent glass plate that is capable of accommodating, for example, an original 11 of A-3 size as a maximum size. Additionally, an original cover, not shown, is normally provided over the document platen 12 so as to prevent entrance of external light.

The exposure section 13, which is conventionally used, is constituted of a plurality of light sources 22 that are disposed in line on a substrate 21, and projects a light beam from the light source 22 onto the document platen 12 through a lens 23. The optical system 14, which is also conventionally used, is constituted of a photoreceptor 24 and a selfoc lens 25 for directing a reflected beam from the document platen 12 to the photoreceptor 24.

The size sensors 15, each of which is installed at one of a plurality of sensing positions, detect the size of an original by sensing whether or not the original is located at the respective sensing positions on the document platen 12. Each size sensor 15 is provided with: a light-emitting element 32 for irradiating the original 11 by light; a light-receiving element 33 for receiving a light beam that has been emitted from the light-emitting element 32 and reflected off the original 11 on the document platen 12; and a signal processing circuit 35 for detecting the presence or absence of the original 11 according to an output signal from the light-receiving element 33. In order to accurately detect the size of the original regardless of the reflection factor of the original, each size sensor 15 also has an output signal detecting circuit 36 for detecting an output signal from the light-receiving element 33 and a driving circuit 37 for controlling the amount of light emission from the light-emitting element 32 in accordance with the results of detection in the output signal detecting circuit 36.

Figure 2:
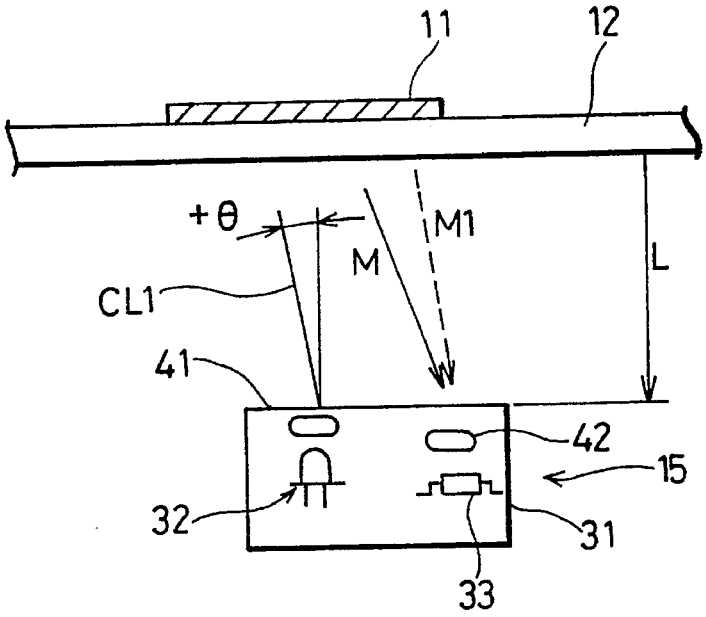
FIG. 2 is a schematic view showing a size sensor used in the document-size detection system.

As illustrated in FIG. 2, the light-emitting element 32 and the light-receiving element 33, together with an irradiation lens 41 and a light-receiving lens 42 that are disposed above them, are installed in a housing 31. An infrared light-emitting diode (LED), which is conventionally used, is employed as the light-emitting element 32, and the amount of light emission thereof is controlled by the driving circuit 37. The light axis of the light-emitting element 32 is inclined to the opposite side to the light-receiving element 33 with respect to the document platen 12 so as to minimize the effect of mirror reflection light that occurs on the document platen 12.

Figure 3:
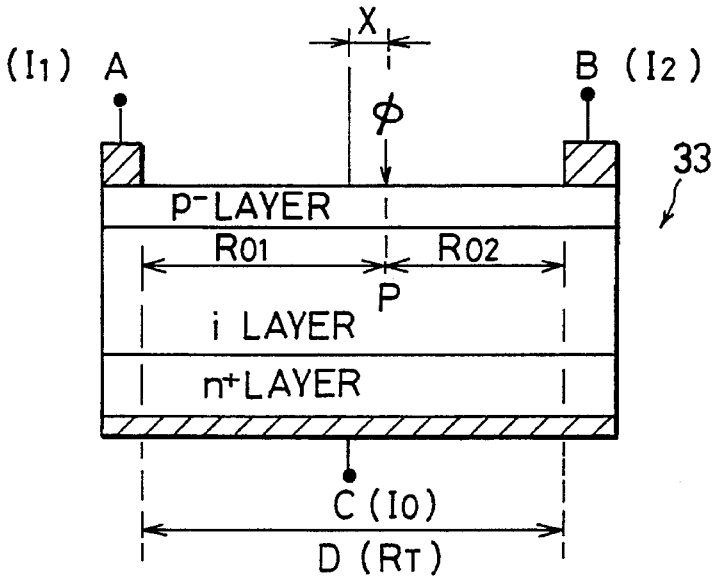
FIG. 3(*a*) is a schematic illustration showing a light-receiving element of the size sensor.
Figure 3:
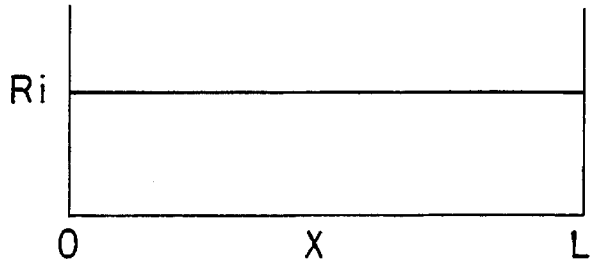

The light-receiving element 33 is a semiconductor position sensitive photodetector (hereinafter, referred to as PSD) that is provided as a light-spot position sensor to which a photodiode (PD) is applied. As illustrated in FIG. 3(*a*), the PSD 33 is constituted of three layers formed on the surface of a silicon chip, that is, a $p^-$layer, $n^+$ layer, and an i layer that is sandwiched therebetween. When a light spot $\phi$ is formed on the surface of the PSD 33, a produced carrier is divided in inverse proportions to distances from the position of the incident light to takeoff electrodes A and B on the resistance layer ($p^-$layer), and taken out from the electrodes A and B respectively as currents $I_1$ and $I_2$. The PSD 33 is thus designed to detect the presence or absence of the original by indirectly measuring distance to the original by the use of a ratio of the currents $I_1$ and $I_2$.

The following description will discuss a principle of the indirect distance-measuring operation of the PSD 33. As illustrated in FIG. 2, a light beam emitted from the light-emitting element 32 is projected onto the original 11 through the irradiation lens 41, and the reflected beam therefrom is incident to the PSD 33 through the light-receiving lens 42. The position of the light spot (light-receipt position) to which reflected beam M is incident varies according to the distance L between the original 11 and the sensor 15. In other words, as the original 11 is located farther apart (as L becomes longer), reflected beam M changes into reflected beam M1, as is indicated by a dotted line in FIG. 2, thereby causing the position of the spot of incident light on the PSD 33 to vary. When the position of the spot of incident light on the PSD 33 varies, the balance of the signal currents $I_1$ and $I_2$ taken out from the both ends of the PSD 33 is altered.

The signal processing circuit 35, which functions as a circuit for detecting the signal currents $I_1$ and $I_2$ from the PSD 33, detects the distance L between the original 11 and the sensor 15 by detecting the balance of the signal currents $I_1$ and $I_2$ as will be described later, thereby making it possible to detect the presence or absence of the original 11.

Here, the following description will discuss a principle of the operation of the signal processing circuit 35 by reference to FIGS. 3(*a*) and 3(*b*). As illustrated in FIG. 3(*a*), suppose that the photocurrent is $I_0$; the distance from the middle point between the electrodes A and B to the position P of the incident light is X; the resistivity from the position P of the incident light to the electrode A is $R_{01}$; the resistivity from the position P of the incident light to the electrode B is $R_{02}$; the distance between the electrodes A and B is D; the resistivity between the electrodes A and B is $R_T$; and the currents taken out from the electrodes A and B are $I_1$ and $I_2$ respectively, the currents $I_1$ and $I_2$ are represented by the following equations (1) and (2).

$$I_1 = \frac{R_{02}}{R_T} I_0 \tag{1}$$

$$I_2 = \frac{R_{01}}{R_T} I_0 \tag{2}$$

Here, the photocurrent $I_0$ is represented by the following equation:

$$I_0 = I_1 + I_2 \tag{3}$$

Since the distribution of the resistivity $R_i$ of the surface resistance layer ($p^-$layer) is uniform as shown in FIG. 3(*b*), the resistivities $R_{01}$ and $R_{02}$ are proportional to the distances from the incident position P to the electrodes A and B, and represented by the following equations:

$$R_{01} = \frac{R_T}{2}\left(1 + \frac{2}{D} X\right) \tag{4}$$

$$R_{02} = \frac{R_T}{2}\left(1 - \frac{2}{D} X\right) \tag{5}$$

When these are respectively substituted in equations (1) and (2), the currents $I_1$ and $I_2$ taken out from the electrodes A and B are represented by the following equations:

$$I_1 = \frac{\frac{R_T}{2}\left(1 - \frac{2}{D}X\right)}{R_T} I_0 \quad (6)$$

$$I_2 = \frac{\frac{R_T}{2}\left(1 + \frac{2}{D}X\right)}{R_T} I_0 \quad (7)$$

Here, the ratio of the addition and difference of the currents I1 and I2 is represented by the following equation:

$$\frac{I_2 - I_1}{I_1 + I_2} = \frac{2X}{D} \quad (8)$$

As described above, by employing the PSD as the light-receiving element 33, direct positional information on the position P of the incident light is obtained from the outputs of the PSD. The value of equation (8) varies in response to the distance L between the original 11 and the sensor 15; therefore, the distance L is detected by the value of equation (8).

Figure 4:
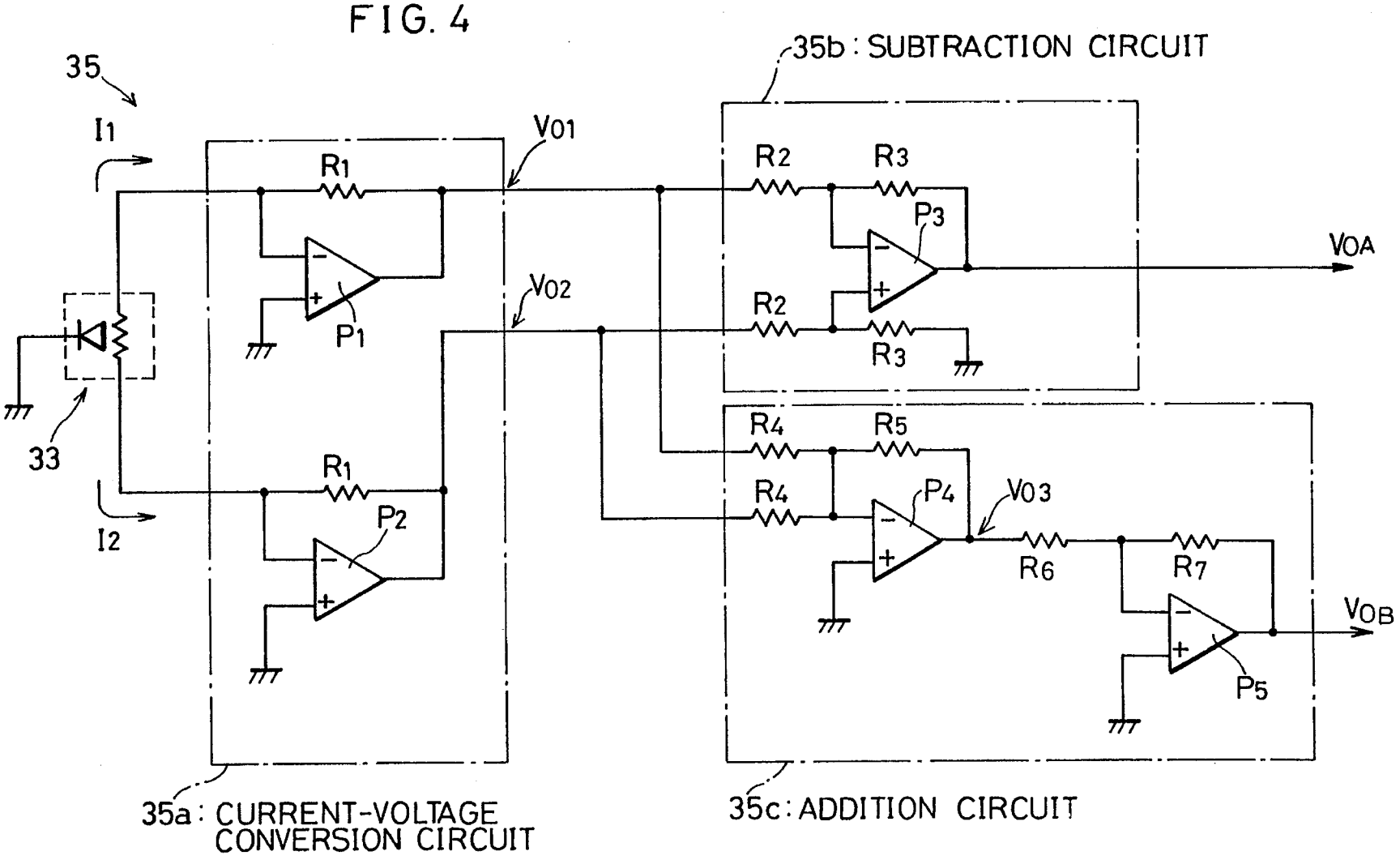
FIG. 4 is a circuit diagram showing one structural example of a signal processing circuit of the size sensor.

FIG. 4 shows one example of the signal processing circuit 35 for processing the signal currents I1 and I2 of the PSD 33. In FIG. 4, R1 through R7 represent resistors and P1 through P5 represent amplifiers. The signal currents I1 and I2 of the PSD 33 are converted into voltages V01 and V02 in a current-voltage conversion circuit 35*a*. V01 and V02 are respectively represented by the equations, V01=R1×I1 and V02=R1×I2. Next, subtraction is made between V02 and V01 in a subtraction circuit 35*b*, thereby resulting in an output voltage $V_{OA}$ that corresponds to I1−I1. $V_{OA}$ is expressed by the following equation:

$$\begin{aligned} V_{OA} &= \frac{R_3}{R_2}(V_{02} - V_{01}) \\ &= \frac{R_3}{R_2} \times R_1 \times (I_2 - I_1) \end{aligned} \quad (9)$$

Moreover, addition is made between V01 and V02 in an addition circuit 35*c*, thereby producing V03. V03 is expressed by the following equation.

$$\begin{aligned} V_{03} &= -\frac{R_5}{R_4}(V_{02} + V_{01}) \\ &= -\frac{R_5}{R_4} \times R_1 \times (I_1 + I_2) \end{aligned} \quad (10)$$

Thus, an output $V_{OB}$ that corresponds to I1+I2 can be obtained. $V_{OB}$ is expressed by the following equation.

$$\begin{aligned} V_{OB} &= -\frac{R_7}{R_6} \times V_{03} \\ &= \frac{R_7}{R_6} \times \frac{R_5}{R_4} \times R_1 \times (I_1 + I_2) \\ &= \frac{R_3}{R_2} \times R_1 \times (I_1 + I_2) \end{aligned}$$

where the following equation holds:

$$\frac{R_3}{R_2} = \frac{R_7}{R_6} \times \frac{R_5}{R_4} \quad (11)$$

$V_{OA}/V_{OB}$ is found by conducting an arithmetic manipulation of $V_{OA}$ and $V_{OB}$ by the use of a microcomputer or other devices. $V_{OA}/V_{OB}$ is expressed by the following equation:

$$V_{OA}/V_{OB} = \frac{R_3/R_2 \times R_1 \times (I_2 - I_1)}{R_3/R_2 \times R_1 \times (I_1 + I_2)} = \frac{I_2 - I_1}{I_1 + I_2} \quad (12)$$

Therefore, as expressed by equation (8), since the result of (I2−I1)/(I1+I2) corresponds to the position of incident light to the PSD 33, the spot position of incident light to the PSD 33 is found through $V_{OA}/V_{OB}$. When the spot position of incident light to the PSD 33 is found, the distance L between the sensor 15 and the original 11 is found, as was described earlier. Thus, by processing the signal currents I1 and I2 of the PSD in the signal processing circuit 35, the distance L between the sensor 15 and the original 11 can be detected.

Figure 5:
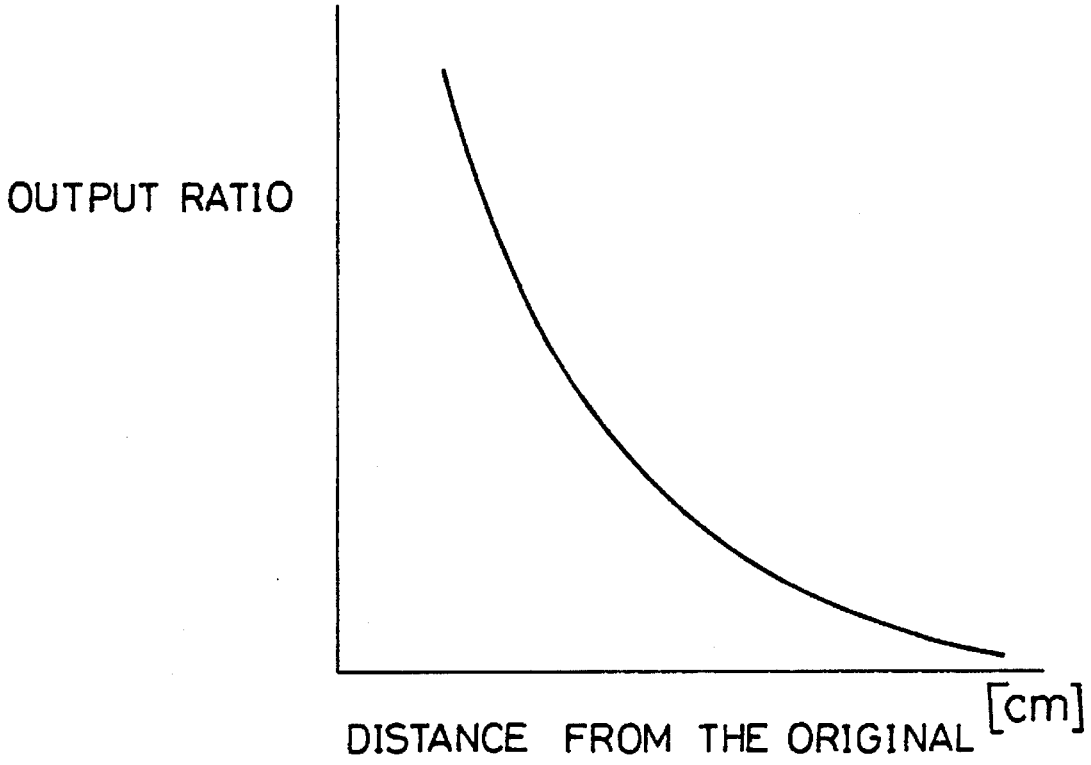
FIG. 5 is a graph showing an output characteristic of the size sensor with respect to the distance from an original.

Here, in order to explain the detection level of the signal processing circuit 35, an outline of the distance characteristic of the output of the size sensor 15 is described with reference to FIG. 5. In FIG. 5, the vertical axis represents the ratio of the two output photocurrents I1 and I2 of the PSD 33, and the horizontal axis represents the distance from the original 11. It is found that these are inversely proportional to each other.

Additionally, when the size of the original 11 is detected by the size sensor 15 in the state where the original cover is closed, the light from the light-emitting element 32 tends to reflect off not only the surface of the original 11 but also from the surface of the cover. In some instances, this makes it difficult for the PSD 33 to distinguish the original 11 from the cover. Therefore, it is desirable to conduct the size detecting operation, for example, immediately before the time when the cover is closed by the operator, that is, at the time when the cover is inclined to a predetermined angle.

As illustrated in FIG. 1, the output signal detecting circuit 36 is disposed between the PSD 33 and the supply power source Vcc for the PSD 33, and is arranged to detect a photocurrent flowing through the PSD 33. The driving circuit 37 controls the amount of light emission from the light-emitting element 32 in inverse proportion to the output level of the output signal detecting circuit 36.

Figure 6:
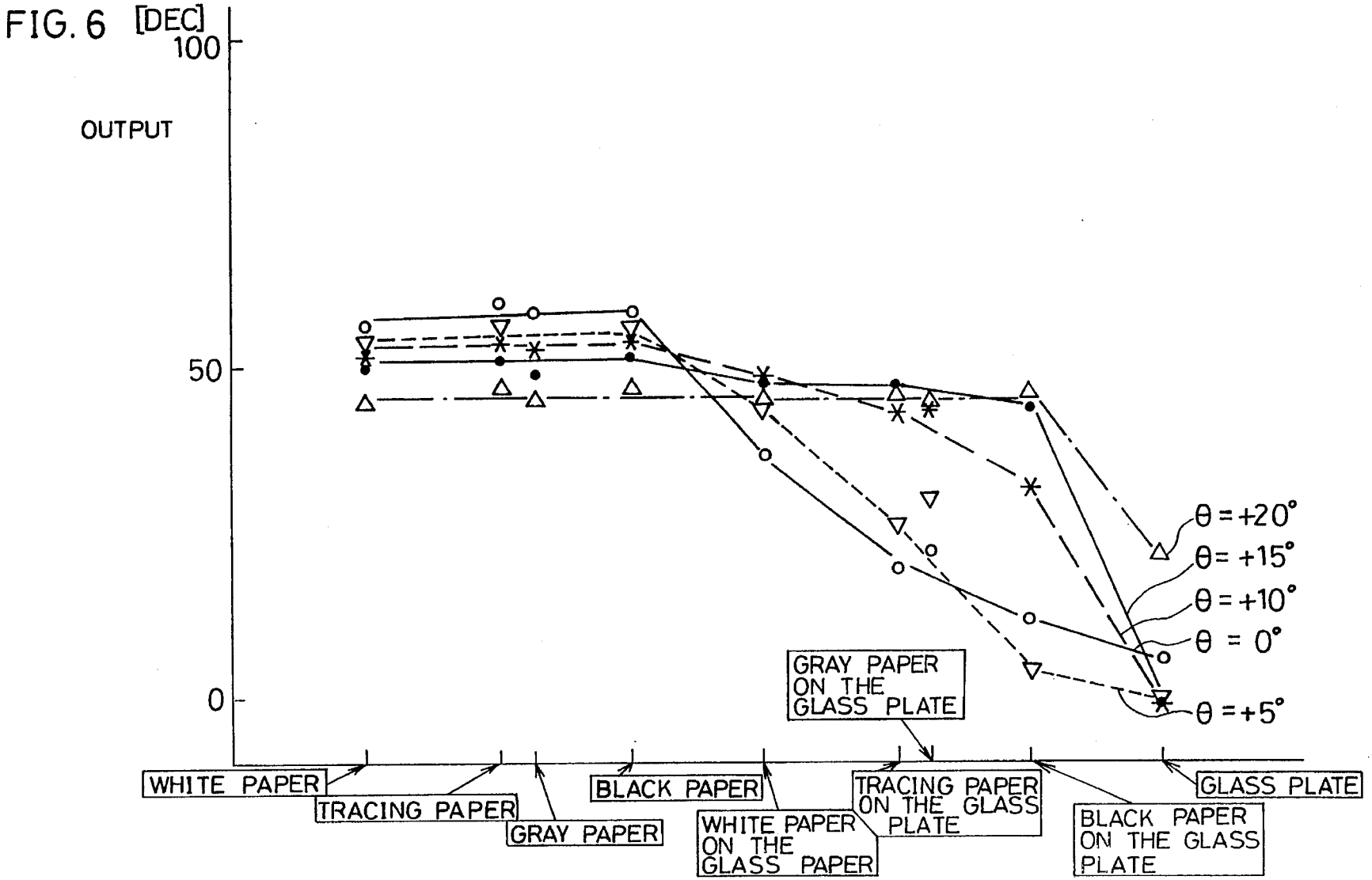
FIG. 6 is a graph showing output characteristics of the size sensor with respect to the inclination of the light axis of the light-emitting element of the size sensor and the colors of the original.

Here, FIG. 6 shows data that were obtained by actually detecting the presence or absence of the original in a copying machine by using the photoelectric size sensor 15. In FIG. 6, θ is an angle that is made between the light axis CL1 of the light-emitting element 32 and the normal line of the glass plate as the document platen 12 (see FIG. 2). That is, for example, the datum, θ=0, represents a datum obtained when the light axis CL1 of the light-emitting element 32 is brought in orthogonal to the glass plate as the document platen 12.

Further, the data, θ=+10°, θ=+15° and θ=+20°, represent data obtained when the light axis CL1 is inclined in a direction opposite to the PSD 33.

Figure 7:
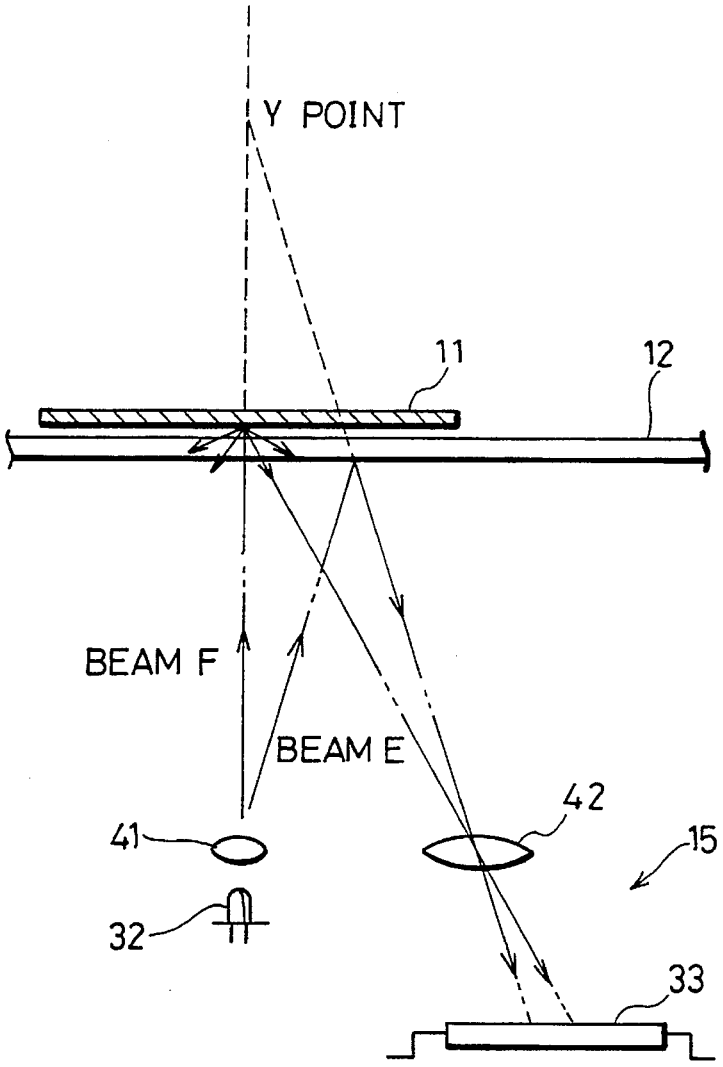
FIG. 7 is a schematic illustration showing a detecting operation of the size sensor.

If detected without the glass plate, a constant output is obtained even in the case where the color (reflection factor) of the original is varied. However, when a sheet of paper is placed on the glass plate, the output fluctuates in accordance with the reflection factor of the sheet of paper. Further, when only the glass plate exists without a sheet of paper, the output fluctuates more abruptly. The reason for this is explained as follows:

FIG. 7 is a schematic view where the size sensor 15 is employed for detecting the presence or absence of the original in the copying machine.

First, in the case where no original 11 is placed on the document platen 12, the LED light emitted from the light-emitting element 32 is separated into two beams: one beam that is reflected off the document platen 12 and the other beam that passes through the document platen 12. As to the reflected beam, since it is reflected off the document platen 12 as if it were reflected off a mirror surface, part of the reflected beam from the document platen 12 which is incident to the PSD 33 is only the beam that has an angle shown in FIG. 7 by the use of a light beam E. In this case, the spot position of the light that is directed in front of the PSD 33 through the lens 42 is formed at the same position as that formed in the case where the original 11 is placed at a position X in FIG. 7. In other words, the ratio of output currents $I_1$ and $I_2$ in the PSD 33 results in an output ratio which indicates that the resulting distance is longer than the actual distance from the document platen 12.

Next, in the case where an original 11 with white surface is placed on the document platen 12, beam F is projected onto the original 11 through the document platen 12, and part of the beam is reflected off the original 11 in a scattered manner. Therefore, in addition to the reflected beam derived from beam E, the part of the beam reflected off the original 11 in a scattered manner is incident to the PSD 33 as a spotted light through the lens 42. This reflected beam derived from beam F is used to obtain correct information for the distance. However, since there is another information that is given by beam E indicating a longer distance, a value, which is slightly shifted closer to the output of the longest distance than the correct output for the distance measurement, is outputted. In other words, as illustrated in FIG. 6, the datum (θ=0) that is obtained when a sheet of bright white paper is placed on the glass plate as the document platen 12 is shifted to be smaller than the correct output.

Further, when the bright white paper on the document platen 12 is replaced with a sheet of paper having a less reflection factor (for example, gray original, black original, etc.), the amount of reflected light derived from the beam F becomes smaller, and the output is further shifted to the output of the longest distance side by the effect of the reflected beam derived from beam E.

However, even in the case of using a sheet of black paper having a low reflection factor that makes the detection most difficult, the output is clearly different from that in the case where only the glass plate exists without an original. Therefore, the presence or absence of the original can be detected by the ratio of the output currents $I_1$ and $I_2$. Here, if the reflection factor of the original 11 varies to become, for example, one half, each of these $I_1$ and $I_2$ becomes one half; therefore, the ratio of $I_1$ and $I_2$ does not vary. In other words, regardless of the reflection factor of the original, an output that corresponds to the distance from the original can be obtained by the photoelectric size sensor. Thus, by using the size sensor 15 equipped with the signal processing circuit 35, even if the output of the PSD 33 varies in response to the presence or absence of the original, it is possible to accurately distinguish the presence and absence of the original regardless of the reflection factor of the original. Therefore, the size of the original can be detected accurately independent of the reflection factor of the original.

Further, even if the LED used as the light-emitting element 32 is subject to deterioration, or even if the amount of the LED light varies according to changes in ambient temperature, the ratio of the output photocurrents $I_1$ and $I_2$ of the PSD derived from the reflected beams of beams E and F that are incident to the PSD does not change. Therefore, it is possible to avoid the deterioration of detection accuracy due to fluctuations of the output caused by deterioration of the LED and changes in ambient temperature. It is also possible to detect the presence or absence of the original more accurately and to detect the size of the original more accurately than a conventional device using the detection method based on the amount of light.

As illustrated in FIG. 2, in order to further improve the detection accuracy of the size of the original by detecting the presence or absence of the original more accurately, it is desirable to alter the angle of the size sensor 15 so that the light axis CL1 of the LED beam from the light-emitting element 32 tilts toward the opposite side to the PSD 33 in a direction indicated by +θ.

Figure 8:
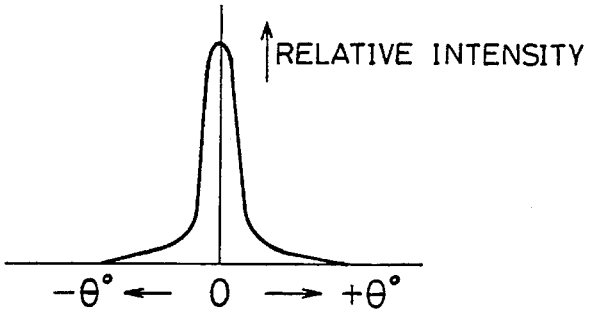
FIG. 8 is a graph showing a directional characteristic of a LED light beam of the size sensor.

The directional characteristics of the LED beam of the size sensor 15 have a relative intensity distribution as shown in FIG. 8. By altering the angle of the size sensor 15 in the direction indicated by +θ, it becomes possible to reduce the amount of light that is incident to the PSD 33 after having been reflected off the face of the document platen 12 in a manner as if reflected off a mirror surface.

FIG. 6 shows data obtained through actual measurements in the case of altering the angle of the size sensor in the direction of +θ. In each of the cases, θ= 10°, θ=+15° and θ=+20° the difference between outputs with only the glass plate and with an original 11 placed on the glass plate becomes greater in comparison with the case of θ=0. Thus, by inclining the light axis of the light-emitting element 32 in the direction of +θ, it becomes possible to detect the presence or absence of the original 11 more easily, thereby making it easier to detect the size of the original.

Figure 9:
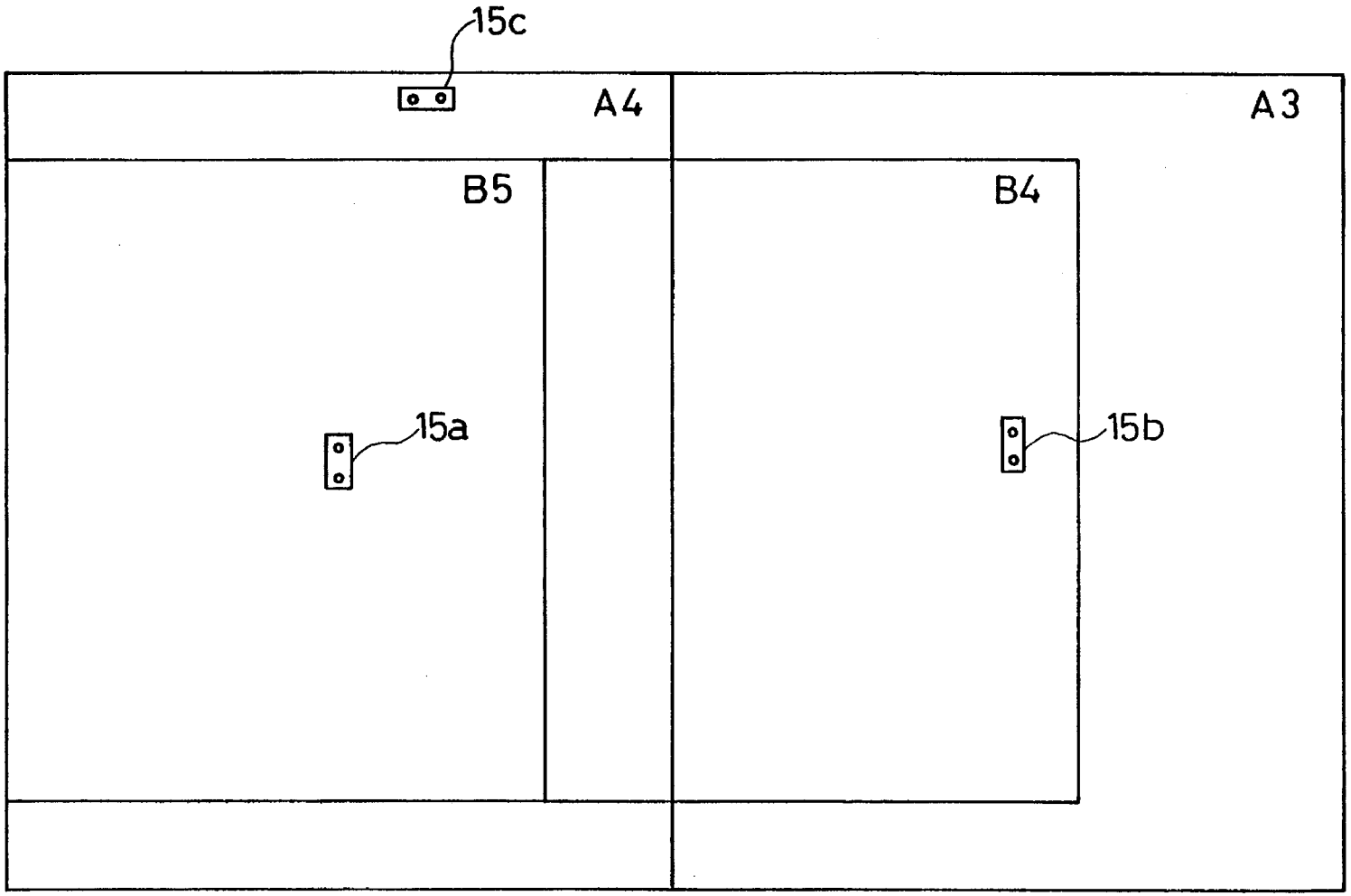
FIG. 9 is a schematic illustration showing the installation positions of the size sensors.

The installation positions of the size sensors 15 are determined, for example, as illustrated in FIG. 9 in the present embodiment. Here, three sensors, the first through the third sensors 15*a* through 15*c* are employed in order to detect the original of four types, that is, B5, B4, A4 and A3. Table 1 shows the relationship between the outputs of the sensors and the sizes of the original.

TABLE 1

| First Sensor Output | Second Sensor Output | Third Sensor Output | Document Size |
|---|---|---|---|
| * | x | x | B5 |
| * | * | x | B4 |
| * | x | * | A4 |
| * | * | * | A3 |

(Note)
*: output in the presence of the original
x: output in the absence of the original Additionally, in order to further minimize the amount of shift toward the longest distance side of the output for distance measurement due to the mirror reflection light from the surface of the glass plate, the irradiation lens 41 and the light-receiving lens 42, installed in front of the light-emitting element 32 and the PSD 33 in the optical system, may be optimized and the directional characteristics of the LED beam may be increased. Thus, it is possible to improve the detection accuracy by minimizing adverse effects of mirror reflection light from the surface of the glass plate.

With the above-mentioned arrangement wherein the size sensors 15 in distance-measuring method, each of which is provided with the light-emitting element 32, the PSD 33 for detecting a spot position of light incident thereto from the original 11, and the signal processing circuit 35 for detecting the distance to the original 11 in accordance with the output signals of the PSD 33, is employed, even if the reflection factor varies due to the color of an original 11, the presence or absence of the original can be detected accurately by using the ratio of a pair of the output currents $I_1$ and $I_2$ that fluctuates in response to the spot position of received light. Here, since the ratio of $I_1$ and $I_2$ does not vary even if the reflection factor of the original 11 becomes low, it is possible to eliminate errors in detecting the size of an original even if the original is dark-colored with a low reflection factor. Further, the ratio of the pair of output currents $I_1$ and $I_2$ does not vary even under changes in the amount of the LED light in the light-emitting element 32 or other events; therefore, it is possible to provide a document-size detection system which has a high detection accuracy in comparison with a conventional method which merely detects and compares the amount of light.

Moreover, since the output signal detecting circuit 36 and the driving circuit 37 are installed, the amount of light emission of the light-emitting element 32 is compensated in response to the amount of light-receiving electric current that flows through the PSD 33, thereby making it possible to further improve the detection accuracy.

Furthermore, since the light axis CL1 of the light-emitting element 32 is inclined with respect to the document platen 12, mirror-surface reflected light from the document platen 12 is restricted so as not to directly enter the PSD 33, and the amount of received light in the absence of the original can be reduced. With this arrangement, the presence or absence of the original can be detected more easily and more accurately, thereby making it possible to prevent erroneous detection even in the case of a low reflection factor of the original.

Additionally, the present invention is not intended to be limited to the above embodiment, and it will be understood that many modifications and changes may be effected within the scope of the present invention.

Figure 10:
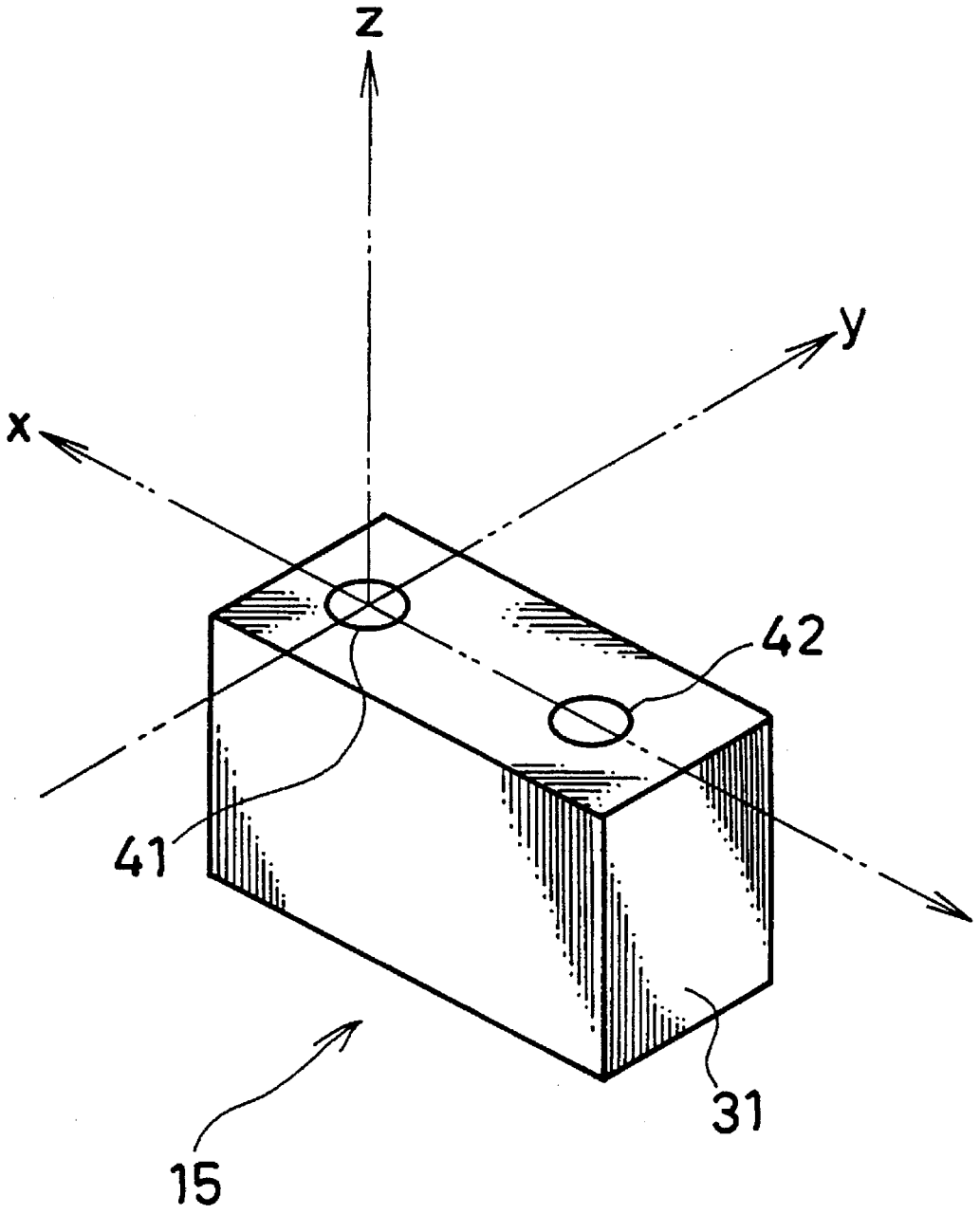
FIG. 10 is a perspective view showing the light-emitting element.

For example, in the above embodiment, an explanation has been given of the case wherein the light axis CL1 of the light-emitting element 32 is tilted in the X-axis direction in FIG. 10; yet, the light axis CL1 of the light-emitting element 32 may be tilted in the Y-axis direction. This arrangement also reduces adverse effects of mirror reflection light from the glass plate, and has the same advantages as that in the case of tilting the axis in the X-axis direction. Moreover, in the above embodiment, the signal processing circuit 35 shown in FIG. 4 is employed; yet, that shown in FIG. 11 may be adopted. In this circuit, reference numeral 51 represents a logarithmic conversion circuit; 52 represents a differential amplifier circuit; and 53 and 54 are log diodes. The outputs of the log diodes 53 and 54, $V_{01}$ and $V_{02}$ are given by the following equations. Here, k is Boltzmannz's Constant; T is absolute temperature (°K); and q is the amount of charge of electron.

$$V_{01} = V_{REF1} - \frac{kT}{q} \ln \frac{I_1}{I_0} \tag{13}$$

$$V_{02} = V_{REF1} - \frac{kT}{q} \ln \frac{I_2}{I_0}$$

Here, the output $V_O$ released from the amplifier circuit 52 is given by the following equation:

$$\begin{aligned} V_O &= \frac{R_2}{R_1}(V_{02} - V_{01}) + V_{REF2} \\ &= \frac{R_2}{R_1} \frac{kT}{q} \ln \frac{I_1}{I_2} + V_{REF2} \end{aligned} \tag{14}$$

This circuit provides an output that corresponds to $\log(I_1/I_2)$. The ratio, $I_1/I_2$, corresponds a spot position of light that is incident to the PSD 33, and the spot position of the light that is incident to the PSD 33 is identified by $\log(I_1/I_2)$. When the spot position of the incident light to the PSD 33 is identified, the distance between the sensor 15 and the original 11 can be detected, as explained earlier.

Moreover, in the present embodiment, the explanation has been given of the PSD as a light-receiving element 33; yet, a photodiode which is divided into two or more divisions may be employed as a light-receiving element 33 in place of the PSD, and the distance measurement may be conducted by using a ratio of its output photocurrents.

Furthermore, in the present embodiment, the output signal detecting circuit 36 and driving circuit 37 are installed so as to accurately detect the size of the original without depending on the reflection factor of the original; yet, these circuits may be omitted. In addition, in each size sensor, two or more light-receiving elements 33 may be installed with respect to a single light-emitting element 32 so as to further improve the positional detection accuracy.

Moreover, in the present embodiment, the explanation has been given of the copying machine as an example; yet, instead of applying to the copying machine, the present invention may be applied to other apparatuses such as image scanners and facsimiles.

[EMBODIMENT 2]

Figure 12:
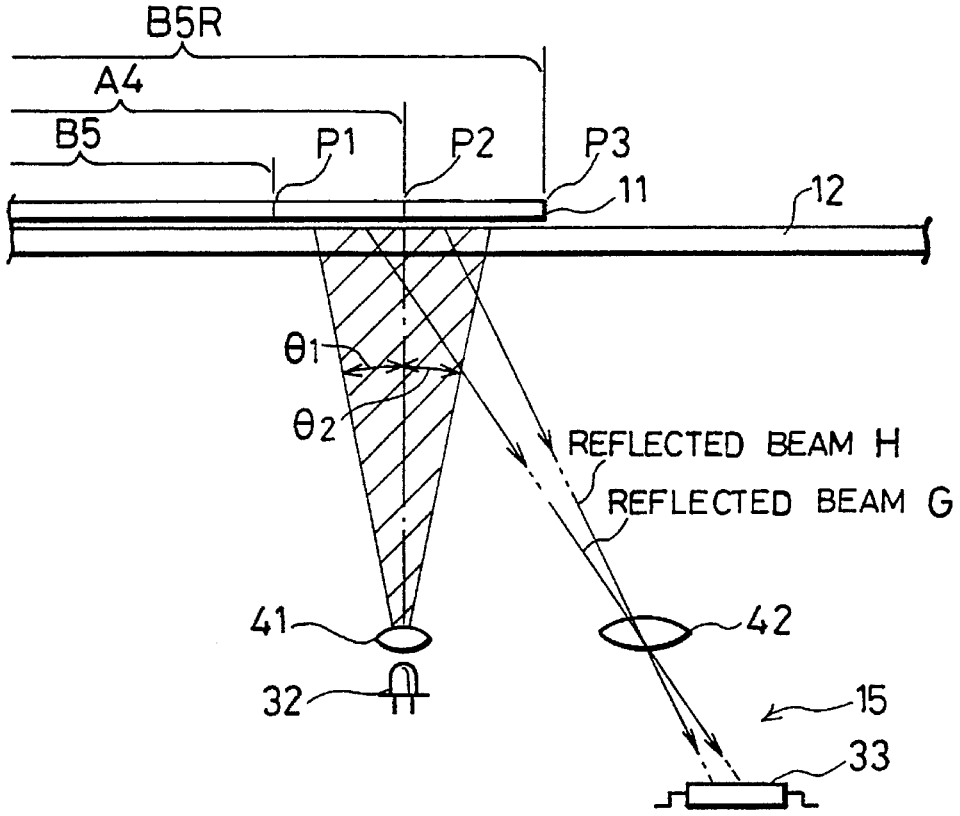
FIG. 12 is a schematic illustration showing a detecting operation of the size sensor in another structural example of the document-size detection system of the present invention.
Figure 13:
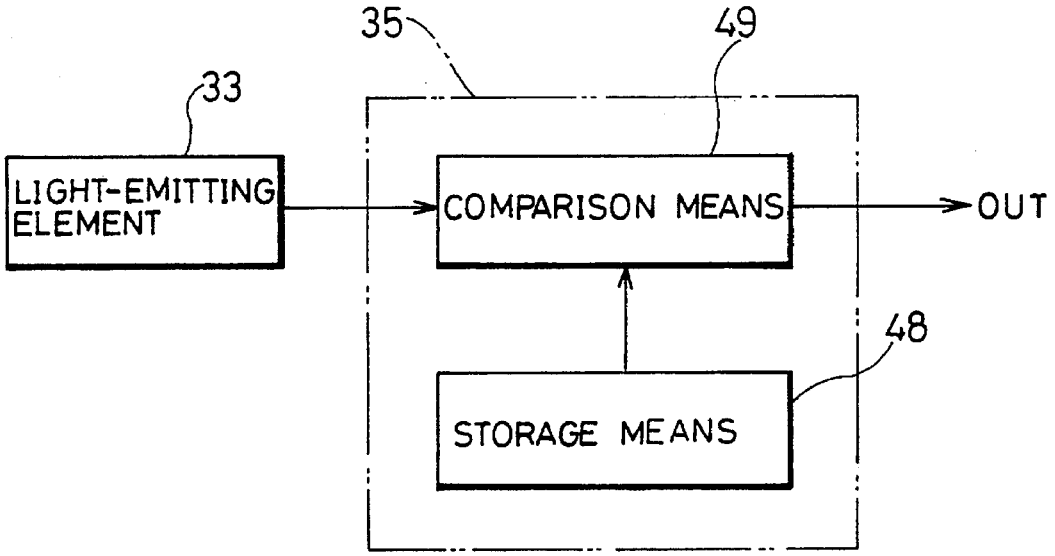
FIG. 13 is a block diagram showing an internal structure of a signal processing circuit that is installed in the size sensor of FIG. 12.
Figure 14:
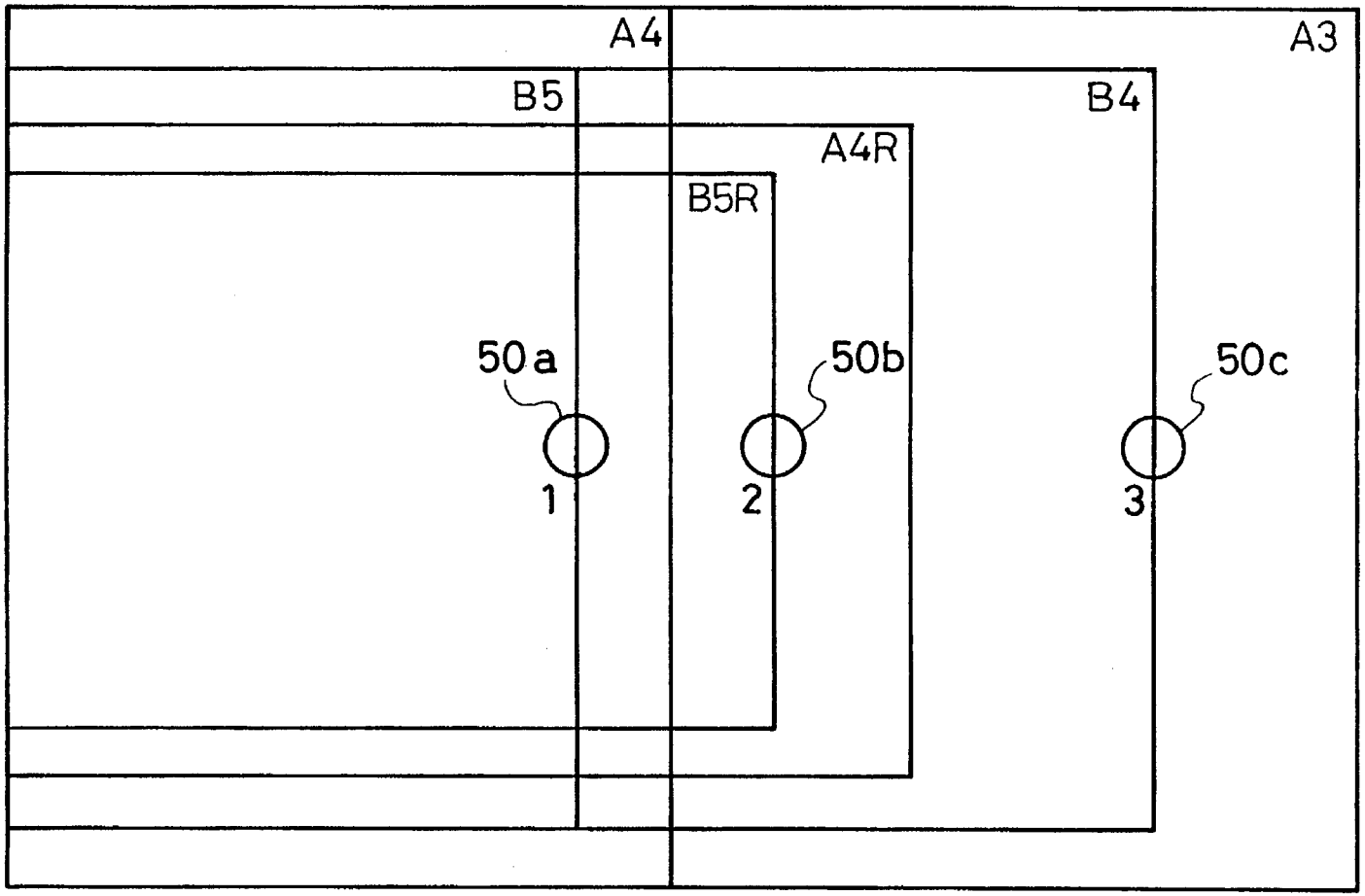
FIG. 14 is a schematic illustration showing the installation positions of the size sensors of FIG. 12.

Referring to FIGS. 12 through 14, the following description will discuss another embodiment of the present invention. Here, for convenience of explanation, those members that have the same functions and that are described in embodiment 1 with reference to the drawings thereof are indicated by the same reference numerals and the description thereof is omitted.

As illustrated in FIG. 12, a document-size detection system of the present embodiment has basically the same structure as that of the document size sensors 15 in embodiment 1. Here, light-directional characteristics of the light-emitting element 32 and the light-receiving element 33 using the PSD are exerted with certain ranges, the sensing region forms a spot shape having a constant area. The document-size detection system of the present embodiment, which utilizes this feature, provides an arrangement wherein the sensing regions are disposed at boundaries of originals having respective sizes and three types of detections are conducted by each sensor according to the facts that the projected light at each sensing region is "entirely reflected" or "reflected only in half" or "not reflected at all". The arrangement makes it possible to reduce the number of the sensors.

For this reason, the signal processing circuit 35 installed in the document-size detection system is designed to read and identify each of the three types of outputs in the light-receiving element 33. More specifically, for example, as illustrated in FIG. 13, the signal processing circuit 35 is provided with a storage means 48 for storing reference output signals with respect to current output ratios obtained from the light-receiving element 33, and a comparison means 49 for comparing a measured value from the light receiving element 33 with the reference output signals of the storage means 48. As to the reference output signals of the storage means 48, three modes are set; that is, "an output signal obtained when light corresponding to all the area is reflected"; "another output signal obtained when only light corresponding to virtually half the area is reflected"; and "the other output signal obtained when no light is reflected" with respect to the irradiated area of light in the above-mentioned sensing region.

As illustrated in FIG. 12, in the case of using an original of size B5, since the original 11 is located only on the left side of point P1, there is no incident light to the light-receiving element 33. In the case of using an original of size A4, since the original 11 is located only on the left side of point P2, only reflected beam G derived from the LED beam θ1 is incident to the light-receiving element 33 through the light-receiving lens 42 to form a light spot thereon. In the case of using an original of size B5R, since the original 11 is located on the left side of point P3, in addition to reflected beam G, reflected beam H derived from the LED beam θ2 is incident to the light-receiving element 33 through the light-receiving lens 42.

In other words, in the respective original sizes of B5, A4 and B5R, three types of outputs of the light-receiving element 33, that is, "an output indicating the absence of reflected beam", "an output derived from reflected beam G"and "output derived from reflected beams G+H" are obtained, and the respective different outputs are obtained in response to changes of the original size. In this case, even if the reflection factor of the original is altered, for example, even if the original is changed from black one of size A4 to white one of size A4, there is no change in the position of light spot on the light-receiving element 33 derived from reflected beam G. Therefore, although the absolute value of the output currents $I_1$ and $I_2$ of the light-receiving element 33 varies, the balance of both currents, that is, the ratio, $I_1/I_2$, does not vary, and is independent of the reflection factor.

Thus, by comparing the output signals from the light-receiving element 33 in the comparison means 49 using the three types of reference output signals stored in the storage means 48, outputs corresponding to the respective sizes of the original can be obtained accurately. Further, even if the light-emitting element 32 is subject to deterioration, or even if the amount of the LED light varies according to changes in ambient temperature, constant outputs corresponding to the respective sizes of the original can be obtained.

For example, as illustrated in FIG. 14, each size sensor 15 of the present embodiment is disposed at one of three sensing positions 50*a* through 50*c* that are set on the boundaries of originals having the respectively different document sizes. Here, the relationship between the outputs of the sensors and the sizes of the original is shown in Table 2.

TABLE 2

| First Sensor Output | Second Sensor Output | Third Sensor Output | Document Size |
|---|---|---|---|
| Non | Non | Non | No Doc. |
| G | Non | Non | B5 |
| G + H | Non | Non | A4 |
| G + H | G | Non | B5R |
| G + H | G + H | Non | A4R |
| G + H | G + H | G | B4 |
| G + H | G + H | G + H | A3 |

(Note)
Non: output indicating no reflected beam.
G: output derived from reflected beam G shown in FIG. 12.
G + H: output derived from reflected beam G + H shown in FIG. 12.

In the above example, original sizes of seven types including non-existence of the original can be detected by using three sensors 115. In this manner, by disposing the size sensors at the boundaries of originals having the respective sizes, the size of the original can be detected by the use of only a few sensors.

As described above, in the present embodiment, the size sensors 15 are disposed at the boundaries of originals having the respective sizes and three different reference output signals are provided in the storage means 49 of the signal processing circuit 35; therefore, a single size sensor 15 can detect three types of the output signals, that is, "the output signal associated with reflected beam corresponding to the entire area", "the output signal associated with reflected beam corresponding to virtually half the area" and "the output signal associated with no reflected beam". Thus, the number of the required size sensors 15 is reduced. Accordingly, since the number of parts is reduced, this arrangement is very effective to cut cost, to simplify the installation work and to save space.

[EMBODIMENT 3]

Figure 15:
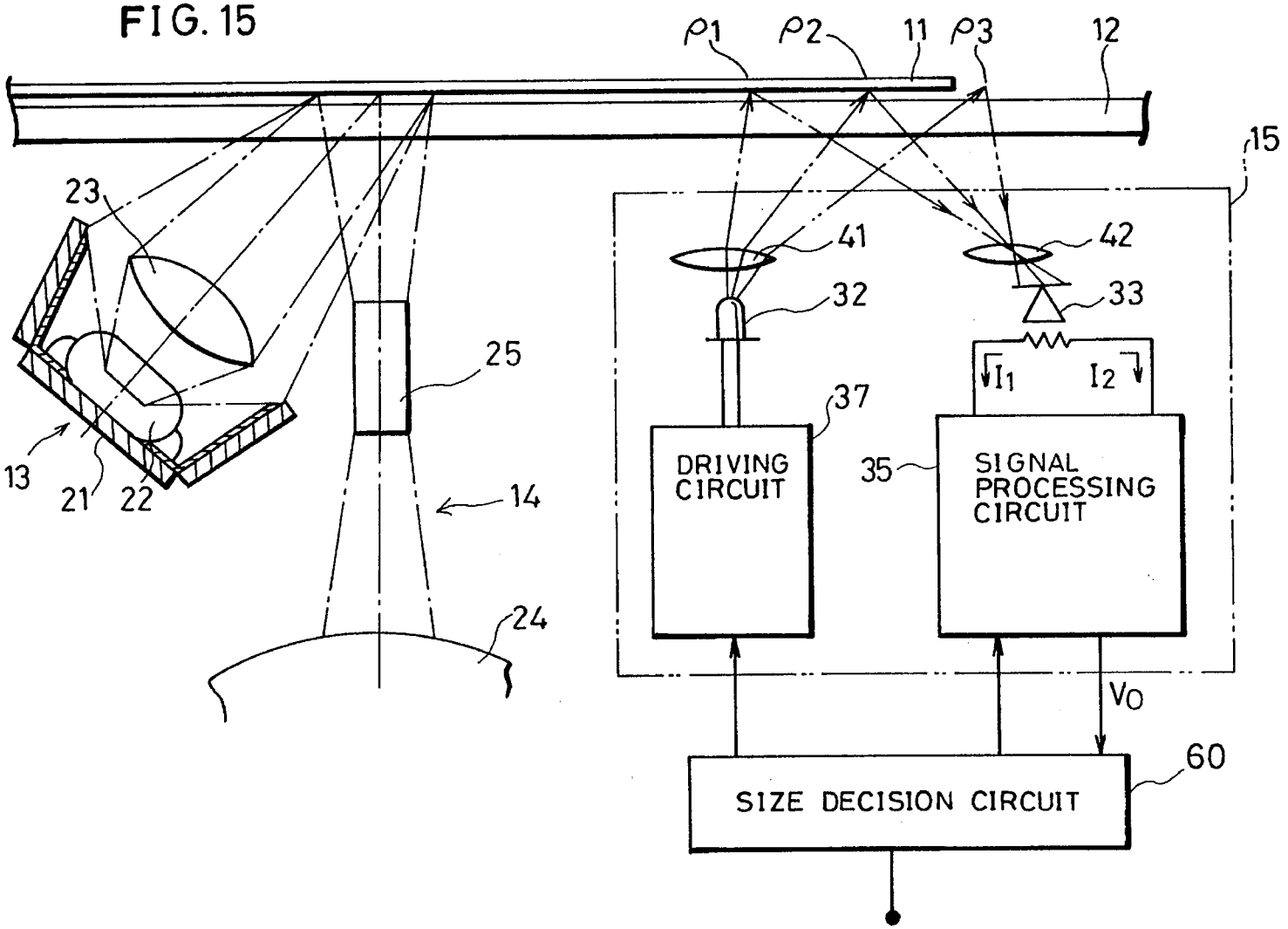
FIG. 15 is a schematic drawing showing still another structural example of the document-size detection system of the present invention.
Figure 16:
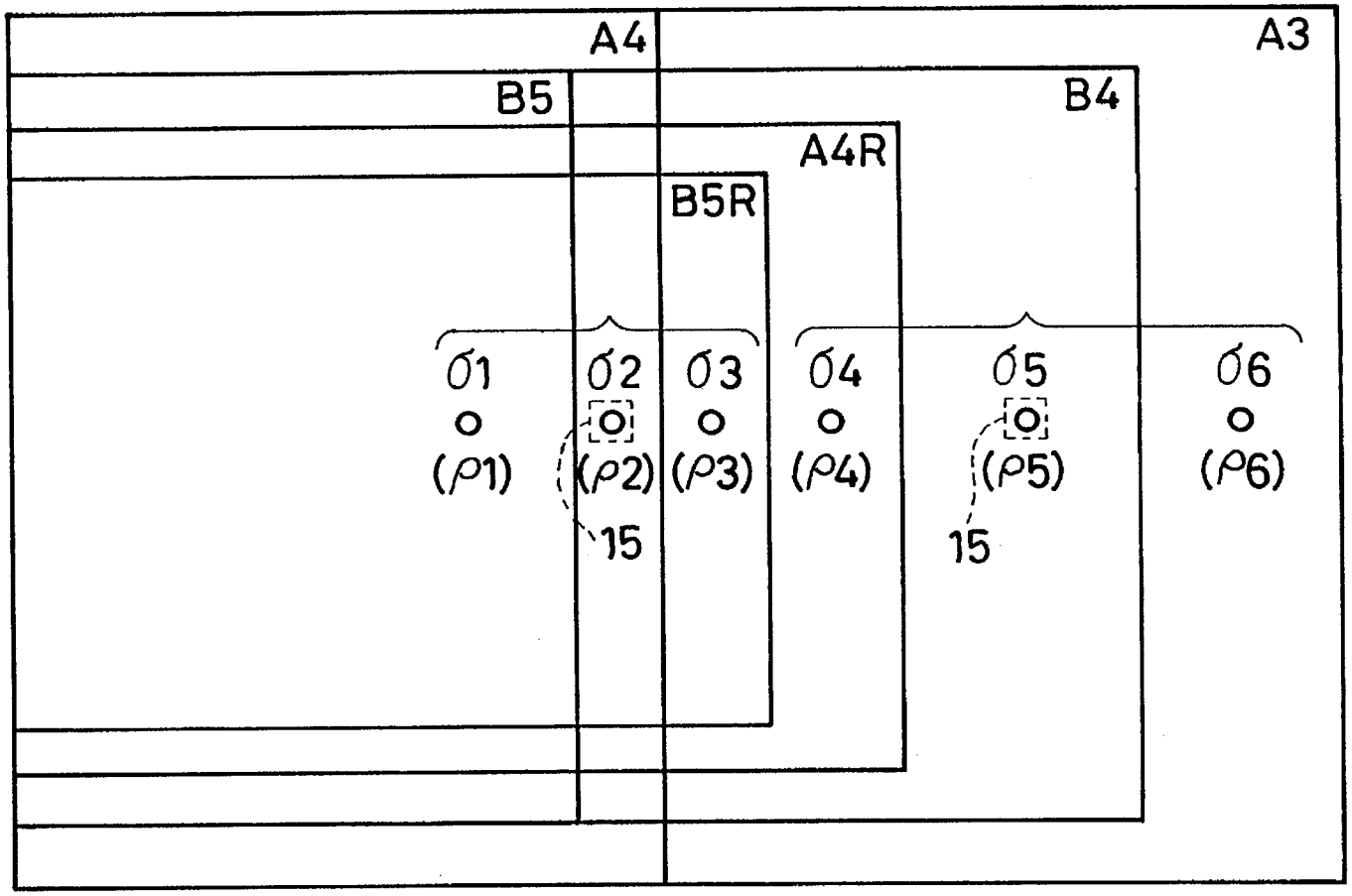
FIG. 16 is a schematic illustration showing the installation positions of the size sensors of the document-size detection system of FIG. 15.
Figure 17:
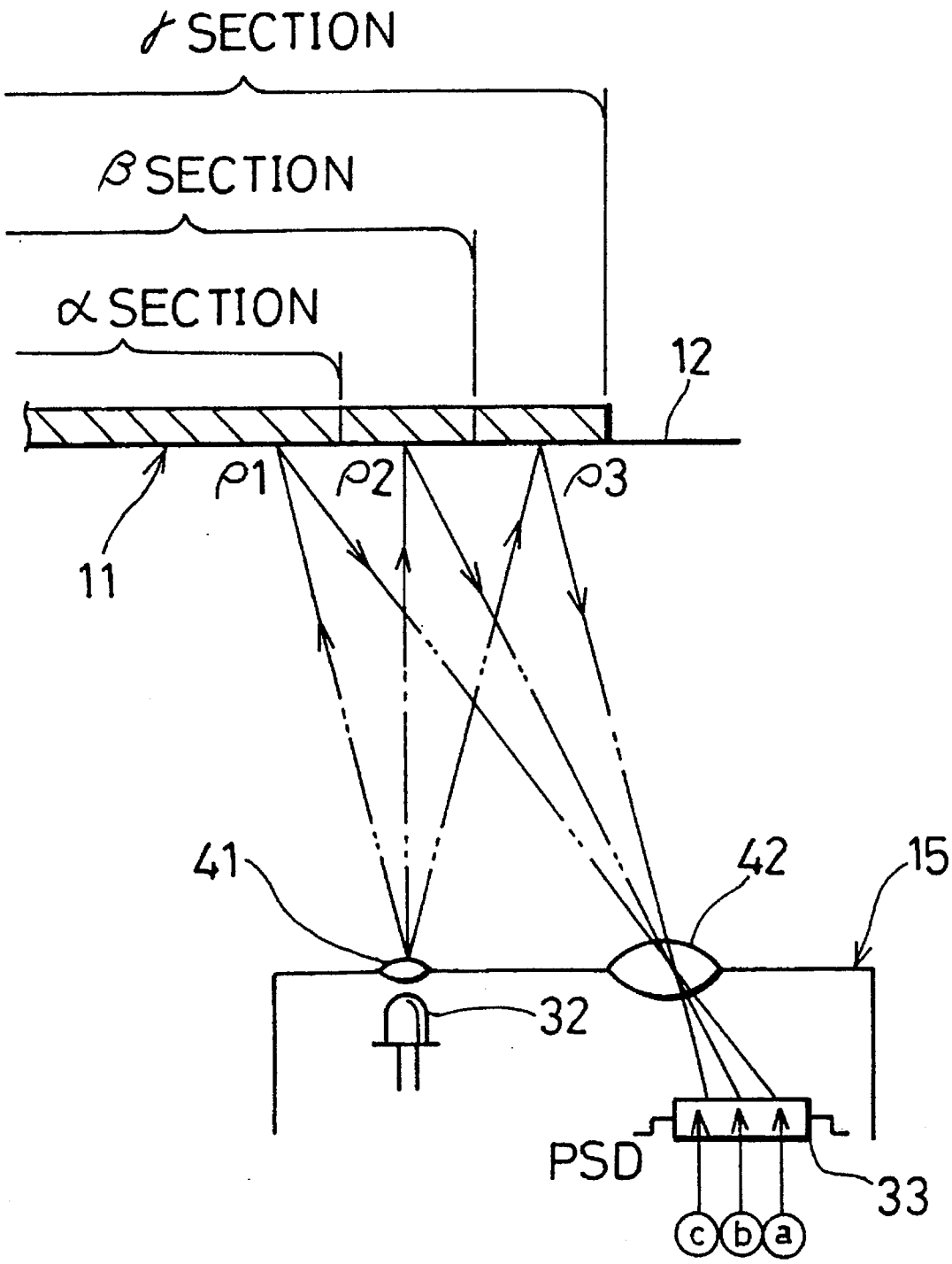
FIG. 17 is a schematic illustration showing a detecting operation of the size sensor of the document-size detection system of FIG. 15.

Referring to FIGS. 15 through 17, the following description will discuss still another embodiment of the present invention. Here, for convenience of explanation, those members that have the same functions and that are described in the aforementioned embodiments with reference to the drawings thereof are indicated by the same reference numerals and the description thereof is omitted.

As illustrated in FIG. 15, a document reader that is provided with a document-size detection system of the present embodiment has virtually the same structure as that described in embodiment 1. The document reader is constituted of a document platen 12 whereon an original 11 is placed, an exposure section 13, an optical system 14, size sensors 15, and size decision circuit 60.

In the same conventional manner, the document platen 12 is made of a transparent glass plate that is capable of accepting, for example, an original 11 of A-3 size as the maximum size. As illustrated in FIG. 16, setting areas σ1, σ2, σ3, σ4, σ5, and σ6 of the originals 11 of the respective sizes (Japanese Industrial Standard [JIS]: [A3], [A4], [A4R], [B4], [B5], and [B5R] are predetermined, and respective sensing positions ρ1, ρ2, ρ3, ρ4, ρ5 and ρ6 are disposed at the setting areas σ1, σ2, σ3, σ4, σ5, and σ6 of the respective sizes.

The document-size detection system is constituted of a plurality of size sensors 15 which detect the presence or absence of the original at those sensing positions (for example, at three points) and the size decision circuit 60 for controlling the size sensors 15 as well as identifying the size of the original according to signals released from the sensors 15. Each size sensor 15 is provided with: a light-emitting element 32 whose viewing angle is designed so as to simultaneously irradiate the sensing positions of, for example, three points ρ1, ρ2, ρ3 and a light-receiving element 33 whose viewing angle is designed so as to simultaneously receive reflected beams from the sensing positions of, for example, three points ρ1, ρ2, ρ3. Except the above arrangement, the size sensor 15 has the same structure as that of embodiment 1.

A conventional infrared light-emitting diode (LED) is employed as the light-emitting element 32. As illustrated in FIG. 17, the viewing angle of the light-emitting element 32 is set to be wide enough to simultaneously irradiate the sensing positions of three points ρ1, ρ2 and ρ3 by adjusting the curvature of the surface of an irradiation lens 41. With this arrangement, the sensing positions can be irradiated by three beams which are projected by the single light-emitting element 32 as if they were projected by three light-emitting elements.

As in embodiment 1, the light-receiving element 33 is constituted of a PSD wherein the ratio of a pair of currents $I_1$ and $I_2$ varies in response to a change in the spot position of a received reflected beam. With this arrangement, the presence or absence of the original 11 is detected in a manner like conducting distance measurements even if the reflection factor changes depending on the color of the original 11, thereby increasing the detection accuracy. The viewing angle of the light,receiving element 33 is set to be wide enough to receive all the beams that are reflected off the sensing positions of three points ρ1, ρ2 and ρ3 after having been projected from the light-emitting element 32 by adjusting the curvature of the surface of the light-receiving lens 42.

Figure 11:
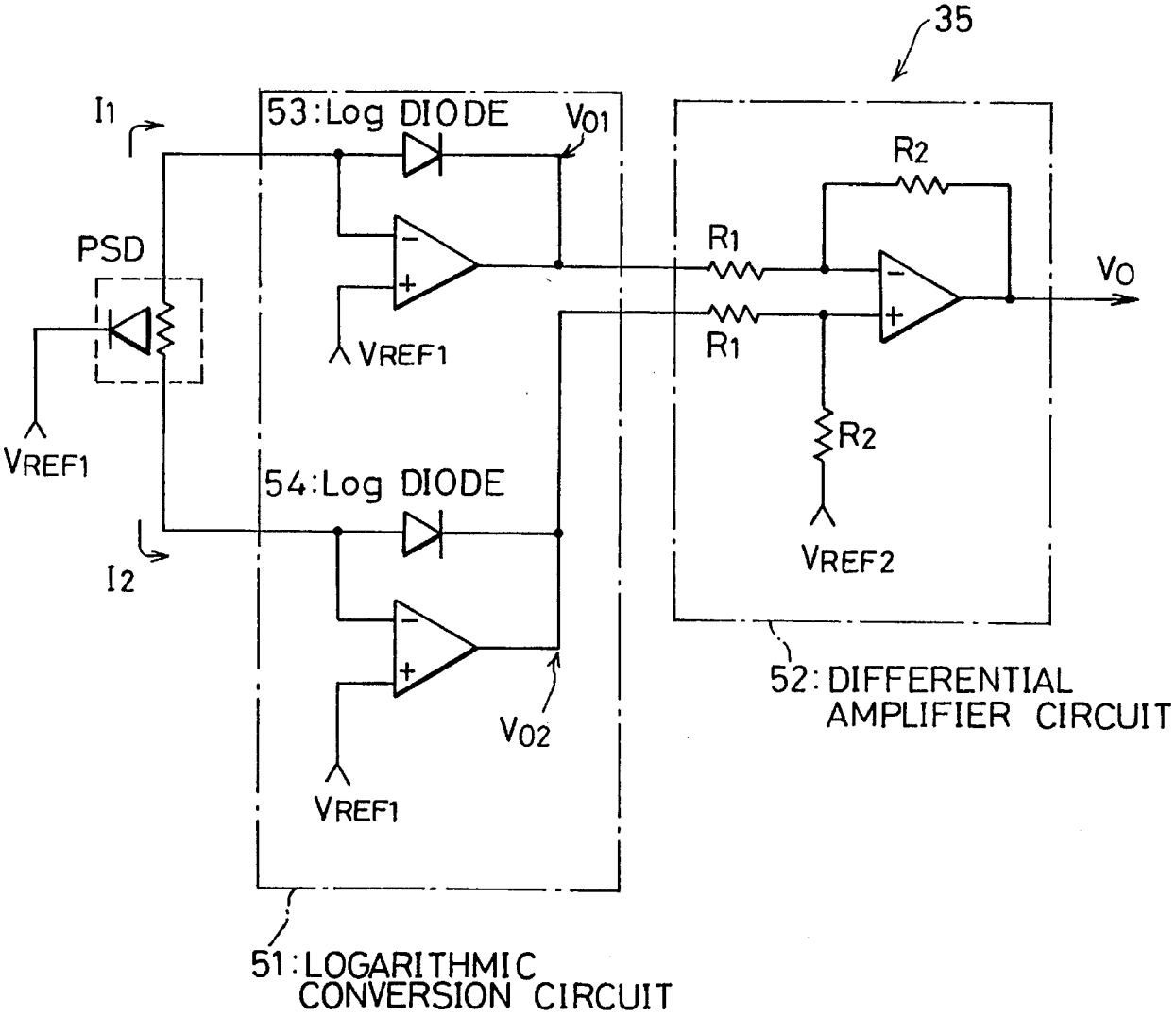
FIG. 11 is a circuit diagram showing another structural example of the signal processing circuit of the size sensor.

The signal processing circuit 35 employed here, which releases a resulting measurement $V_O$ in response to the output signal from the light-receiving element 33, is the same as that shown in FIG. 4 or FIG. 11.

For example, as illustrated in FIG. 16, the size sensors 15 are disposed at two positions corresponding to the points ρ2 and ρ5. In other words, each size sensor 15 can simultaneously senses the sensing positions of three points, as described earlier. Therefore, when it is arranged to sense the six points ρ1, ρ2, ρ3, ρ4, ρ5 and ρ6, one size sensor 15 is used for sensing the points ρ1, ρ2 and ρ3, and another size sensor 15 is used for sensing the rest of the points ρ4, ρ5 and ρ6. Thus, the document sizes of six types corresponding to the respective setting areas σ1, σ2, σ3, σ4, σ5, and σ6 are detected in accordance with the results of detection on the presence or absence of the original obtained at the respective sensing positions.

The size decision circuit 60 activates the signal processing circuit 35 and the driving circuit 37, for example, at the time when the original cover, not shown, of the document platen 12 is inclined to a predetermined angle before being closed, that is, at the time immediately before the original 11 is held by the original cover, and receives resulting measurements $V_O$ from the respective size sensors 15, thereby identifying the size of the original by the combination of the presence and absence of the original 11 at the sensing positions. Here, the judgement on the inclined angle of the original cover may be conducted by a device such as an actuator that is fixed to the original cover.

In the above arrangement, after placing an original 11 on the document platen 12, the original 11 is held on the document platen 12 by closing the original cover. In the course of closing the original cover, at the time when the original cover is inclined to the predetermined angle, the size decision circuit 60 activates the signal processing circuit 35 and the driving circuit 37.

When the driving circuit 37 allows the light-emitting element 32 to emit light, the sensing positions of three points ρ1, ρ2 and ρ3 are simultaneously illuminated, as shown in FIG. 17. If the original 11 to be sensed is located at section α, a spot position of the reflected beam derived from the original 11 is formed at point a of the light-receiving element 33. Further, if the original 11 to be sensed is located at section β, the center of a spot position is situated in the middle point of point a and point b of the light-receiving element 33 because the reflected beams derived from the original 11 are incident to both point a and point b of the light-receiving element 33. Furthermore, if the original 11 to be sensed is located at section γ, the center of a spot position is situated in the middle point of point a and point c with point b in between, that is, at point b of the light-receiving element 33 because the reflected beams derived from the original 11 are incident to all of the point a, point b and point c of the light-receiving element 33.

As described above, the spot position of the reflected beam on the light-receiving element 33 varies depending on the sizes of the original 11, and the ratio of a pair of currents $I_1$ and $I_2$ varies accordingly. Based on the ratio, the signal processing circuit 35 sends the resulting measurements $V_O$ to the size decision circuit 60.

In this case, although the reflection factor of light tends to change depending on the color of the original 11, the presence or absence of the original 11 can be detected as a ratio of the pair of electric currents that varies according to positions of light spots by using the PSD for detecting the spot position of the reflected beam. Since the ratio of the electric currents does not vary even if the reflection factor of the original 11 decreases, the detection accuracy is improved in comparison with an arrangement wherein merely the amount of light is detected.

These detecting operations are carried out on each of the two size-sensors 15.

Thereafter, the original 11 is exposed from under the document platen 12 by the use of the exposure section 13, and the light beam emitted from the exposure section 13 and reflected off the original 11 on the document platen 12 is read by the reading section 14.

As described above, in the document-size detection system of the present invention, the viewing angles of the light-emitting element 32 and the light-receiving element 33 are respectively set to be wide in such a manner that upon detecting the size, the single light-emitting element 32 simultaneously projects light beams to the sensing positions of three points ρ1, ρ2 and ρ3 while the single light-receiving element 33 receives the reflected beams from the respective sensing positions of three points ρ1, ρ2 and ρ3. Then, decision is made as to which sensing position a particular reflected beam is derived from by reading out a ratio of a pair of the currents $I_1$ and $I_2$ that corresponds to a spot position of light incident to the light-receiving element 33. In this manner, by using the two size-sensors 15, the presence or absence of the original 11 is detected at the respective sensing positions of six points ρ1, ρ2, ρ3, ρ4, ρ5 and ρ6, and based on the combination of the results, the document size can be identified. Accordingly, the number of the light-emitting elements 33 and the light-receiving elements 34 is reduced.

As described above, in comparison with the prior art arrangement wherein six size sensors are required, the arrangement of the present embodiment accomplishes the sensing function successfully for the sensing positions of six points ρ1, ρ2, ρ3, ρ4, ρ5 and ρ6 by using only two size-sensors 15. Unlike the prior art arrangement, since it is not necessary to dispose those sensor units at six positions, the number of parts may be reduced by unifying those parts, and this results in cost reduction in parts. Accordingly, this arrangement is very effective to simplify the installation work as well as to save space.

Additionally, in the present embodiment, one light-emitting element 32 simultaneously illuminates the three points ρ1, ρ2 and ρ3 of the sensing positions; yet, another arrangement may be proposed, wherein three light-emitting elements 32 are installed in one size sensor 15 so as to illuminate the three points ρ1, ρ2 and ρ3 simultaneously. However, the number of parts is reduced more effectively in the arrangement wherein light released from one light-emitting source is separated into three beams by using a lens or the like, and the cost of sensor per one beam can be reduced.

[EMBODIMENT 4]

Figure 18:
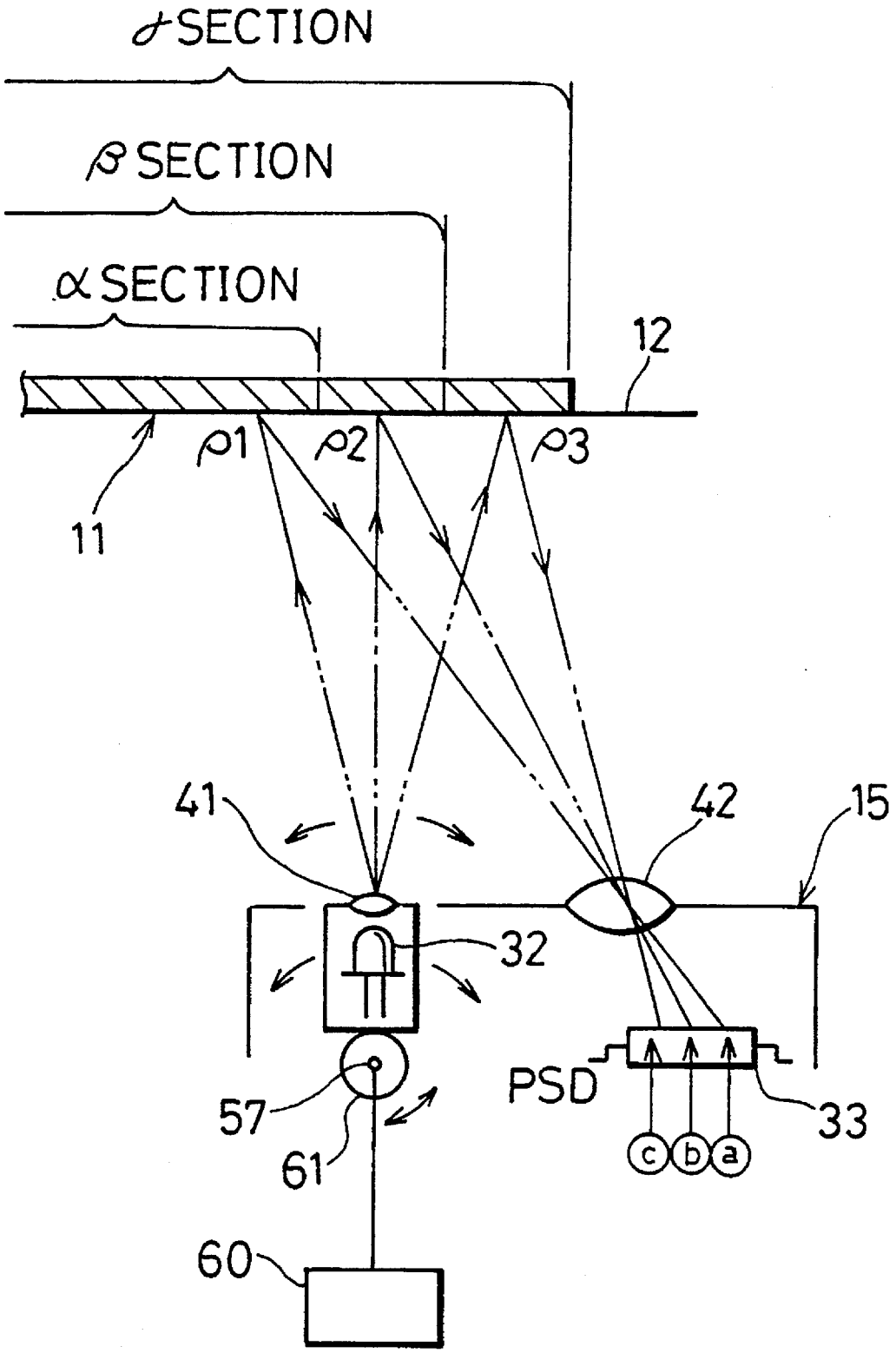
FIG. 18 is a schematic illustration showing a detecting operation of the size sensor in still another structural example of the document-size detection system of the present invention.
Figure 19:
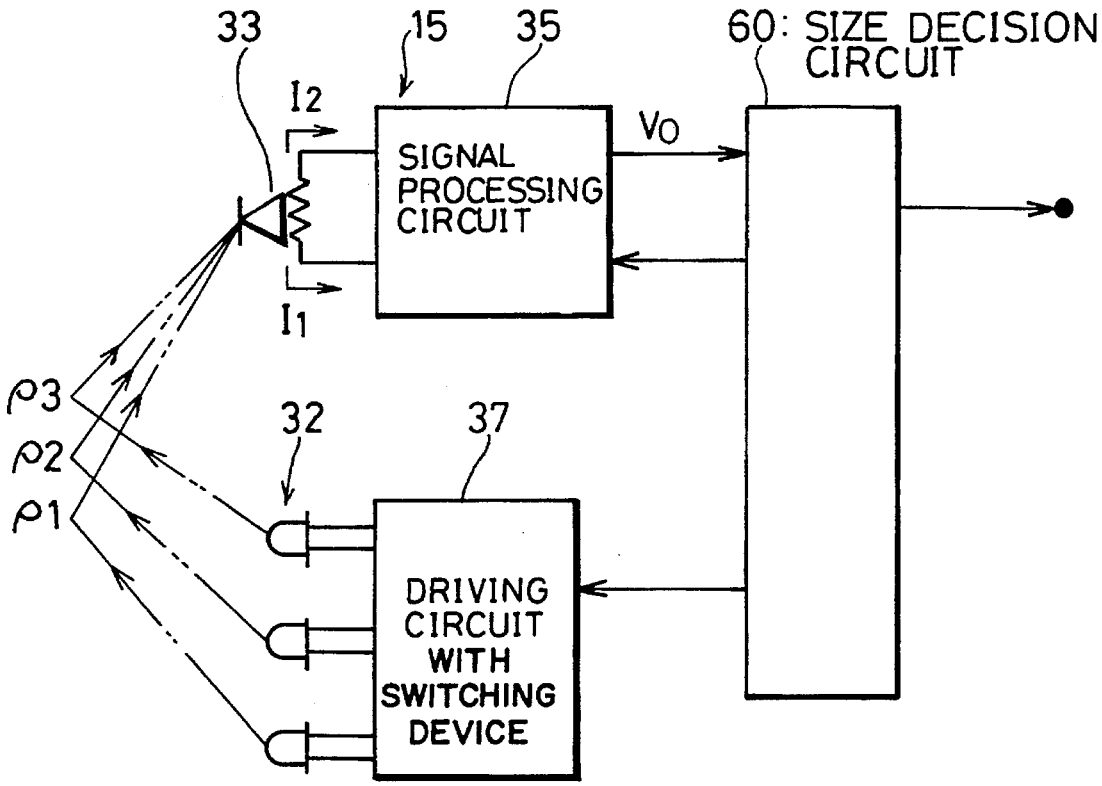
FIG. 19 is a schematic view showing still another structural example of the document-size detection system of the present invention.

Referring to FIGS. 18 and 19, the following description will discuss still another embodiment of the present invention. Here, for convenience of explanation, those members that have the same functions and that are described in the aforementioned embodiments with reference to the drawings thereof are indicated by the same reference numerals and the description thereof is omitted.

In the document-size detection system of the present embodiment, the viewing angle of the light-emitting element 32 in the size sensor 15 is set to be narrow such that only one sensing position is irradiated. As illustrated in FIG. 18, below the light-emitting element 32 there is installed an inclined movement means 61 (time-series changing means) for changing the irradiation angle of the light-emitting element 32 according to time series so as to successively irradiate the sensing positions of three points ρ1, ρ2 and ρ3. The inclined movement means 61 is constituted of, for example, a stepping motor which permits the light-emitting element 32 and the irradiation lens 41 to pivot around a central axis 57, and is driven by the size decision circuit 60.

The other arrangement of the document-size detection system of the present embodiment is virtually the same as that of embodiment 3. Further, the reading operation of the resulting measurements $V_O$ from the signal processing circuit 35, which takes place in the size decision circuit 60, is conducted in synchronism with the pivotal movement of the inclined movement means 61.

Also in the present embodiment, the viewing angle of the light-receiving element 33 is set to be wide enough to receive all the beams reflected off, for example, three points ρ1, ρ2 and ρ3 of the sensing positions. Therefore, also in the present embodiment, only two size-sensors 15 are enough to be required to sense the sensing positions of six points ρ1, ρ2, ρ3, ρ4, ρ5 and ρ6, as is illustrated in FIG. 16.

In the above arrangement, the inclined movement means 61 is activated by the size decision circuit 60 in such a manner that the three points ρ1, ρ2 and ρ3 of the sensing positions are successively irradiated as the irradiation angle of the light-emitting element 32 is changed according to time series. In this case, the arrangement of the present embodiment is the same as that described in embodiment 3 in that the sensing positions of six points ρ1, ρ2, ρ3, ρ4, ρ5 and ρ6 are divided into two groups. Yet, the action of the light-receiving element 33 is different from that described in embodiment 3 in that the sensing operation is carried out on each group according to the time series. Thereafter, the size decision circuit 60 reads out the resulting measurements $V_O$ from the signal processing circuit 35 in synchronism with the operation of the inclined movement means 61 that takes place according to time series.

As described above, in the present embodiment, the viewing angle of the light-emitting element 32 is set to be narrow and the irradiation point of the light-emitting element 32 with respect to a plurality of the sensing points is changed according to time series; therefore, the irradiation point is restricted to one sensing position. Since the amount of change in spot positions of the reflected beam on the light-receiving element 33, which occurs due to difference of the sizes of the original, becomes clearer, it is possible to detect the size of the original more accurately. However, sensing time becomes longer in comparison with that in embodiment 3.

Here, in the present embodiment, a single light-emitting element 32 is used for irradiating a plurality of sensing positions by changing the irradiation points by the use of the inclined movement means 61; yet, as shown in FIG. 19, another arrangement may be adopted, wherein each light-emitting element 32 is disposed to have a one-to-one correspondence with each sensing position and only the light-receiving element 33 is adapted to deal with a plurality of sensing positions. Moreover, in the above case wherein a plurality of the light-emitting elements 32 are installed for the individual sensing positions, a switching device or the like, which allows those light-emitting elements 32 to emit light successively, may be employed as a time-series changing means for changing the irradiation angle of the light-emitting element 32 according to time series.

Moreover, in the above-mentioned embodiments 3 and 4, the number of the sensors 15 is limited to two, each functioning as a three-beam sensor. Yet, characteristics of three or more beams may be imparted to the sensor 15, or the sensor 15 may be provided as a two-beam sensor.

[EMBODIMENT 5]

Figure 20:
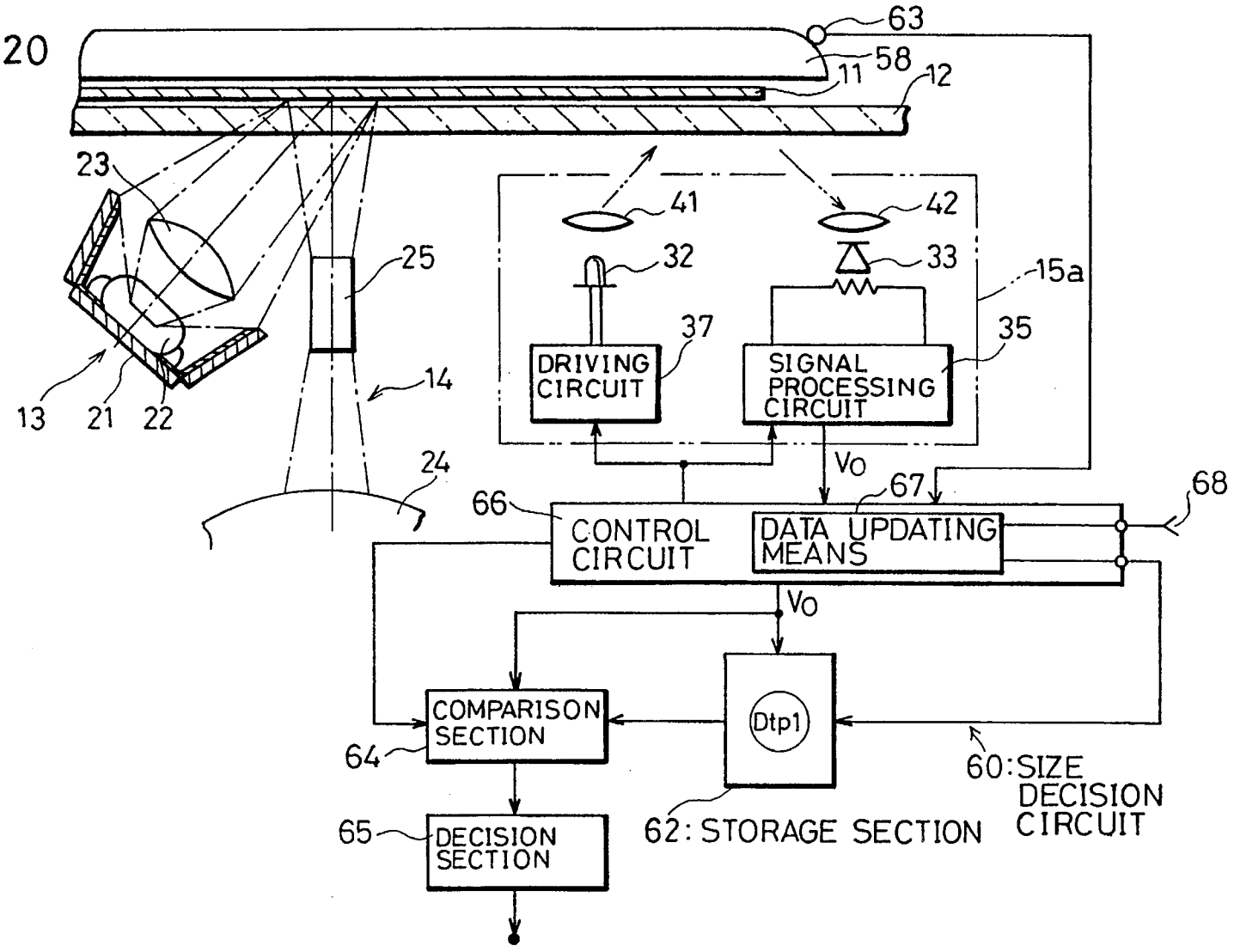
FIG. 20 is a schematic view showing still another structural example of the document-size detection system of the present invention.
Figure 21:
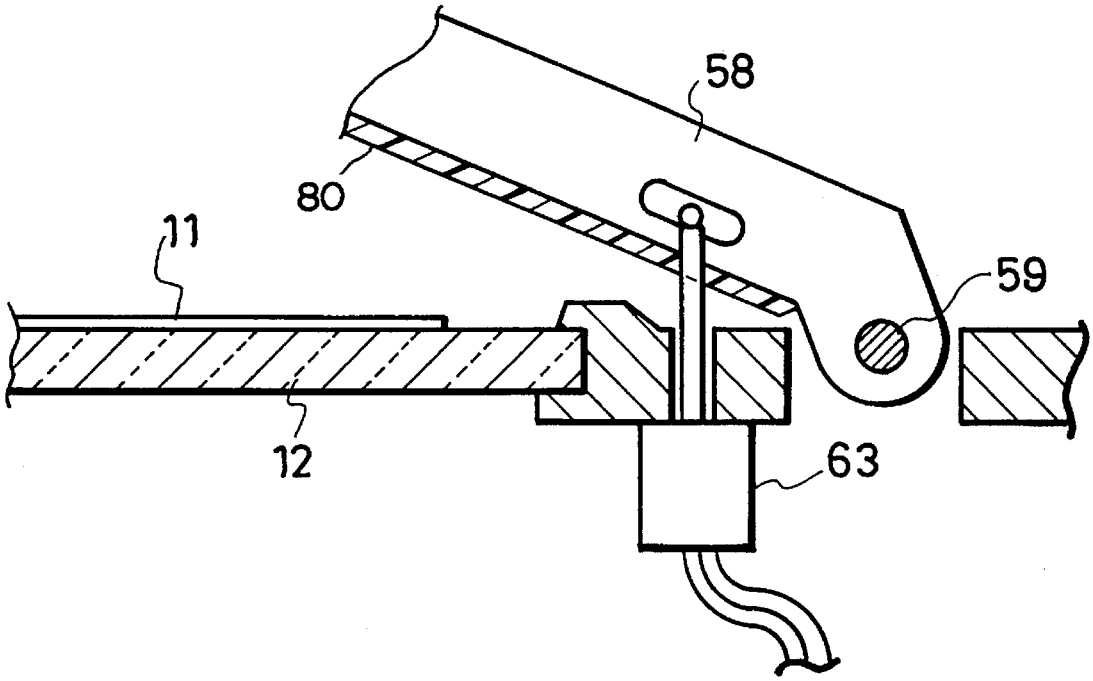
FIG. 21 is a sectional view showing an inclined-state detection means and its periphery, which is installed in the document-size detection system of FIG. 20.

Referring to FIGS. 20 and 21, the following description will discuss still another embodiment of the present invention. Here, for convenience of explanation, those members that have the same functions and that are described in the aforementioned embodiments with reference to the drawings thereof are indicated by the same reference numerals and the description thereof is omitted.

As illustrated in FIG. 20, a document reader that is provided with a document-size detection system of the present embodiment has virtually the same structure as that described in embodiment 1 . The document reader is constituted of a document platen 12 whereon an original 11 is placed, a cover (document cover) 58 for holding the original 11 on the document platen 12, an exposure section 13, an optical system 14, size sensors 15, and size decision circuit 60.

As illustrated in FIG. 21, the cover 58, which prevents external light from entering the document platen 12, is rotatably supported by an lateral axis 59 at one side of the document platen 12. A resin sheet 80 having a light-scattering property similar to that of paper material is affixed to the lower surface of the cover 58. The reason that the resin sheet is affixed thereto is because it makes the optical system 14 as well as the size sensors recognize as if there were an original when the cover 58 is closed even in the case where there is no original placed thereon.

As illustrated in FIG. 20, the document-size detection system is constituted of: a plurality of size sensors 15 for detecting the presence or absence of an original at a plurality of sensing positions; and a size decision circuit 60 for identifying the size of the original 11 according to the resulting measurements of the size sensors 15 when the cover 58 of the document reader is inclined to a predetermined angle.

Each size sensor 15 has the same structure as that described in embodiment 1, and those sensors 15 are installed at positions, for example, shown in FIG. 9.

As in embodiment 1, the light-receiving element 33, which receives a reflected beam that is derived from a light beam reflected off the original 11 after having been emitted from the light-emitting element 32, is constituted of a PSD wherein the ratio of a pair of currents $I_1$ and $I_2$ varies in response to a change in the spot position of the received reflected beam. With this arrangement, the presence or absence of the original 11 is detected in a manner like conducting distance measurements even if the reflection factor changes depending on the color of the original 11, thereby increasing the detection accuracy.

Moreover, even in the case where an object other than the original 11 is placed on the document platen 12, since the PSD is employed as the light-receiving element 33, the presence or absence of the object is detected regardless of quality of its material. By utilizing this function, the light-receiving element 33 is also used as a closed-state detection means for detecting the closed-state of the cover 58 of the document reader.

The signal processing circuit 35 employed here, which releases a resulting measurement $V_O$ in response to the output signal from the light-receiving element 33, is the same as that shown in FIG. 4 or FIG. 11.

The size decision circuit 60 is provided with commonly used microcomputer chips or other devices wherein a CPU, a ROM and a RAM are employed. The size decision circuit 60 is constituted of the light-receiving element 33 that also functions as the closed-state detection means, a storage section 62, an inclined-state detection means 63, a comparison section 64, a decision section 65 and a control circuit 66.

When the light-receiving element 33 releases an on-state signal upon receipt of the reflected beam from the cover 58 in the closed-state, the storage section 62 stores the resulting measurement $V_O$ at this time as a reference datum Dtp1 in the presence of the original according to the output signal.

Additionally, the reference data Dtp1 in the presence of the original are referred to as "output signal data of the light-receiving element 33 in the presence of an original on the document platen 12". Here, since the resin sheet having a light-scattering property similar to that of paper material is affixed to the lower surface of the cover 58, the light-receiving element 33 recognizes as if there were an original because of the reflected beam from the resin sheet even if there is no original placed thereon when the cover 58 is actually closed. Therefore, whether or not an original is actually placed, the resulting measurements $V_O$ in the case of closing the cover 58 are simply stored as the reference data Dtp1 in the presence of the original.

The inclined-state detection means 63 is constituted of conventional position sensors such as microsensors using actuators, reflection-type photo-interruptors or proximity sensors. As illustrated in FIG. 21, the inclined-state detection means 63, which detects a state where the cover 58 is inclined to a predetermined angle, is disposed in the vicinity of the lateral axis 59 of the cover 58. The inclined angle to be detected is set to be a minute angle. The reason is that detection timing of the document size is made immediately before the cover 58 is closed.

Upon recognizing that the cover 58 is inclined to the predetermined angle according to the inclined-state timing signal from the inclined-state detection means 63, the comparison section 64 reads the reference data Dtp1 in the presence of the original that have been stored in the storage section 62, and compares each of the reference data Dtp1 in the presence of the original with the resulting measurement $V_O$ of each size sensor 15. This comparing operation is carried out with respect to each of a plurality of the size sensors 15.

The decision section 65 identifies the size of the original 11 according to the result of comparison made in the comparison section 64. In other words, when the result of comparison in the comparison section 64 shows that "the difference between a newly obtained resulting measurement $V_O$ in the size sensor 15 and the reference datum Dtp1 in the presence of the original exceeds a predetermined permissible range", the decision section 65 makes a decision that "there is no original 11" at the relevant sensing position of the size sensor 15. In contrast, if the result of comparison in the comparison section 64 shows that "the difference between a newly obtained resulting measurement $V_O$ in the size sensor 15 and the reference datum Dtp1 in the presence of the original lies within a predetermined permissible range", the decision section 65 makes a decision that "there is an original 11" at the relevant sensing position of the size sensor 15. The decision section 65 makes this decision for each of the plural size sensors 15, and identifies the size of the original 11 based on the combinations of the presence or absence of the original 11 at respective predetermined positions.

The control circuit 66 controls the driving operations of circuits 35 and 37 of each size sensor 15, the comparison section 64, the decision section 65, etc. upon receiving respective timing signals released from the document reader. The timing signals are inputted thereto through a timing input terminal 68.

In most cases, when the power source of the document reader is on, the cover 58 is closed. For this reason, it is desirable to store the reference data Dtp1 in the presence of the original in the storage section 62 upon activating the document reader. Thus, the document reader is arranged so that it automatically releases a timing signal to the timing input terminal 68 upon turning on the power source. It is also desirable to allow the control circuit 66 to drive the light-receiving element 33, the storage section 62, etc. especially when the power source of the document reader is turned on.

Moreover, for the same reason as described above, it is desirable to provide an arrangement wherein the reference data Dtp1 in the presence of the original already stored in the storage section 62 can be updated upon resetting the document reader or on other occasions such as at any timing that is specified by the operator. In other words, a data updating means 67 is installed in the control circuit 66, and when the timing signal from the timing input terminal 68 is inputted thereto, the reference data Dtp1 in the presence of the original in the storage section 62 is updated, if necessary.

In the above arrangement, the power source of the document reader is first turned on. At this time, the timing signal is automatically released to the timing input terminal 68, thereby permitting the control circuit 66 to drive the light-receiving element 33, the storage section 62, etc. Further, from this time on, the light-emitting element 32 continues to emit light until the power source of the document reader is turned off.

If the cover 58 is closed when the power source of the document reader is turned on, the storage section 62 stores the resulting measurement $V_O$ at this time as a reference datum Dtp1 in the presence of the original according to a signal from the light-receiving element 33 that detects the closed-state of the cover 58. Here, as described earlier, when the cover 58 is closed, whether or not an original is actually placed, the resulting measurement $V_O$ in the case of closing the cover 58 is simply stored as a reference datum Dtp1 in the presence of the document.

In contract, if the cover 58 is not closed when the power source of the document reader is turned on, the signal from the light-receiving element 33 informs the control circuit 66 of the fact that the cover 58 is not closed. Since it is not necessary to store the resulting measurement $V_O$ at this time in the storage section 62, the control circuit 66 does not send the resulting measurement $V_O$. Thereafter, the control circuit 66 keeps on driving the light-receiving element 33 and the storage section 62, or periodically drives these devices at given intervals, and at the time when the cover 58 is closed for the first time, the resulting measurement at that time is stored in the storage section 62 as a reference datum Dtp1 in the presence of the original.

Next, the cover 58 is opened, and after placing an original 11 on the document platen 12, the original 11 is held on the document platen 12 by closing the cover 58. In the course of closing the cover 58, at the time when the cover 58 of the document reader is inclined to the predetermined angle, the control circuit 66 receives resulting measurements $V_O$ from the size sensors 15 according to the respective inclined-state timing signals released from the inclined-state detection means 63.

In this case, if the original 11 is located at the predetermined sensing position of the size sensor 15, the light beam emitted from the light-emitting element 32 is reflected off the original 11 and the reflected beam is directed to the light-receiving element 33, and an output signal from the light-receiving element 33 is detected by the signal processing circuit 35. Then, the signal processing circuit 35 sends the resulting measurement $V_O$to the control circuit 66.

In contrast, if there is no original 11 located at the sensing position of the size sensor 15, most of the light beam emitted from the light-emitting element 32 passes through the document platen 12, and proceeds upward; this results in little reflected light to be incident to the light-receiving element 33. Thus, the signal processing circuit 35 transmits to the control circuit 66 an output signal from the light-receiving element 33 that is derived from little amount of light as a resulting measurement $V_O$.

In this case, although the reflection factor of light tends to change depending on the color of the original 11, the presence or absence of the original 11 can be detected as a ratio of the pair of electric currents that varies according to positions of light spots, by employing the PSD for detecting the position of the spot of the reflected beam. Since the ratio of the electric currents does not vary even if the reflection factor of the original 11 decreases, the detection accuracy is improved in comparison with an arrangement wherein merely the amount of light is detected. These detecting operations are carried out on each of the size-sensors 15.

Then, the control circuit 66 sends to the comparison section 64 the new resulting measurement $V_O$ on each of the size sensors 15 sent from the signal processing circuit 35. The comparison section 64 compares the resulting measurement $V_O$ on each of the size sensors 15 with the reference data Dtp1 in the presence of the original, which have been stored in the storage section 62. In accordance with the result of comparison made in the comparison section 64, the decision section 65 makes a decision as to the present or absence of the original at each position of the size sensor 15, and thus identifies the size of the document 11. The information concerning the result of the decision is transmitted to other operation systems, such as those concerning the reduction rate and the support of the data area of the document reader.

Thereafter, the original 11 is exposed from under the document platen 12 by the use of the exposure section 13, and the light beam emitted from the exposure section 13 and reflected off the original 11 on the document platen 12 is read by the reading section 14.

As described above, by employing the PSD as the light-receiving element 33, the variation of the spot position of received light can be detected as the variation of the ratio of a pair of electric currents; therefore, the presence or absence of the original, or the size of the original, is accurately detected without being affected by the color (reflection factor) of the original.

Generally speaking, however, there are variations in the amount of light emission in the light-emitting element 32 and there are variations in sensitivity or other aspects in the light-receiving element 33. Therefore, in the case where a plurality of size sensors 15 are employed to detect the size of the document, in order to make a decision on the resulting measurements $V_O$ of the size sensors 15 by comparing them with an absolute reference value, it is necessary to compensate and adjust variations in the characteristics of respective sensors 15 by the use of a method such as operating a variable resistor.

However, as described above, in the present embodiment, the reference data Dtp1 in the presence of the original are preliminarily stored in the storage section 62, and the size of the original is identified by relatively comparing the resulting measurements $V_O$ of the respective size sensors 15 with the reference data Dtp1 in the presence of the original. Therefore, since the document-size detection system is allowed to have an automatic compensating function, it is not necessary to provide an operation for adjusting output variations between individual sensors.

Further, if an erroneous detection on the presence or absence of the original should occur due to changes in environmental conditions such as ambient temperature changes, the reference data Dtp1 in the presence of the original stored in the storage section 62 can be updated by the data updating means 67. Thus, even if the reference Dtp1 in the presence of the original comes to disagree with actual environmental conditions, the data are updated at will, and it becomes possible to eliminate erroneous detection in the future operation.

Further, when the cover 58 of the document reader is actually closed, the light-receiving element 33 detects this state, and the reference data Dtp1 in the presence of the original at this time are stored in the storage section 62; thus, the storage operation is automated and the efficiency thereof is increased. Moreover, the light-receiving element 33, as it is, is combinedly utilized as the closed-state detection means of the cover 58, thereby preventing an increase in the number of parts. Furthermore, by employing the PSD as the light-receiving element 33, the detection as to whether or not the cover 58 is closed is conducted in the same manner as detecting the presence or absence of the original 11.

Additionally, in the above embodiment, the light-receiving element 33 that is combinedly used as the closed-state detection means is driven when the power source of the document reader is on, and detection is made as to whether or not the cover 58 of the document reader is closed. Yet, the present invention is not limited to this arrangement. When the power source of the document reader is on, the resulting measurement $V_O$ may be compulsively stored in the storage section 62 as the reference data Dtp1 in the presence of the original. In this case, even if the power source is turned on with the cover 58 opened, no problem is arisen because the reference data Dtp1 in the presence of the original stored in the storage section 62 can be updated later so as to have the correct contents ($V_O$ obtained with the cover 58 closed) by the data updating means 67 through an operation such as pressing a reset button after the cover 58 has been closed. With this arrangement, upon activating the power source of the document reader, the reference data Dtp1 in the presence of the document are stored in the storage section 62; therefore, the storage operation is automated and the efficiency thereof is increased.

Further, in the above embodiment, the light-receiving element 33 is utilized, as it is, as the closed-state detection means in order to reduce the number of parts; yet, the inclined-state detection means 63 may be utilized, as it is, for the same purpose to reduce the number of parts.

Moreover, the size sensors 15 are located at the positions, for example, as illustrated in FIG. 14 in the same manner as embodiment 2; yet, those sensors 15 may be located at other positions.

[EMBODIMENT 6]

Figure 22:
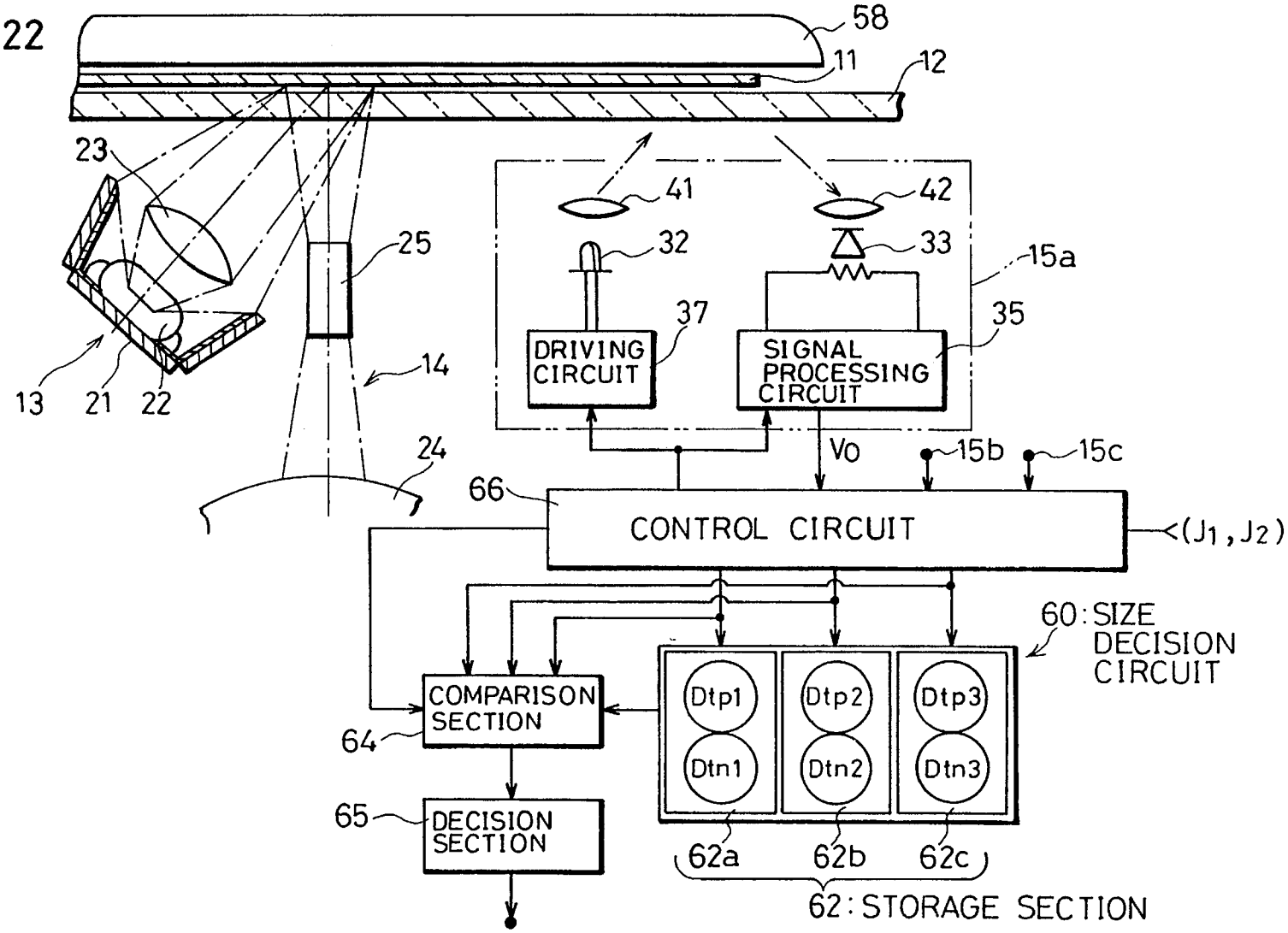
FIG. 22 is a schematic view showing still another structural example of the document-size detection system of the present invention.
Figure 25:
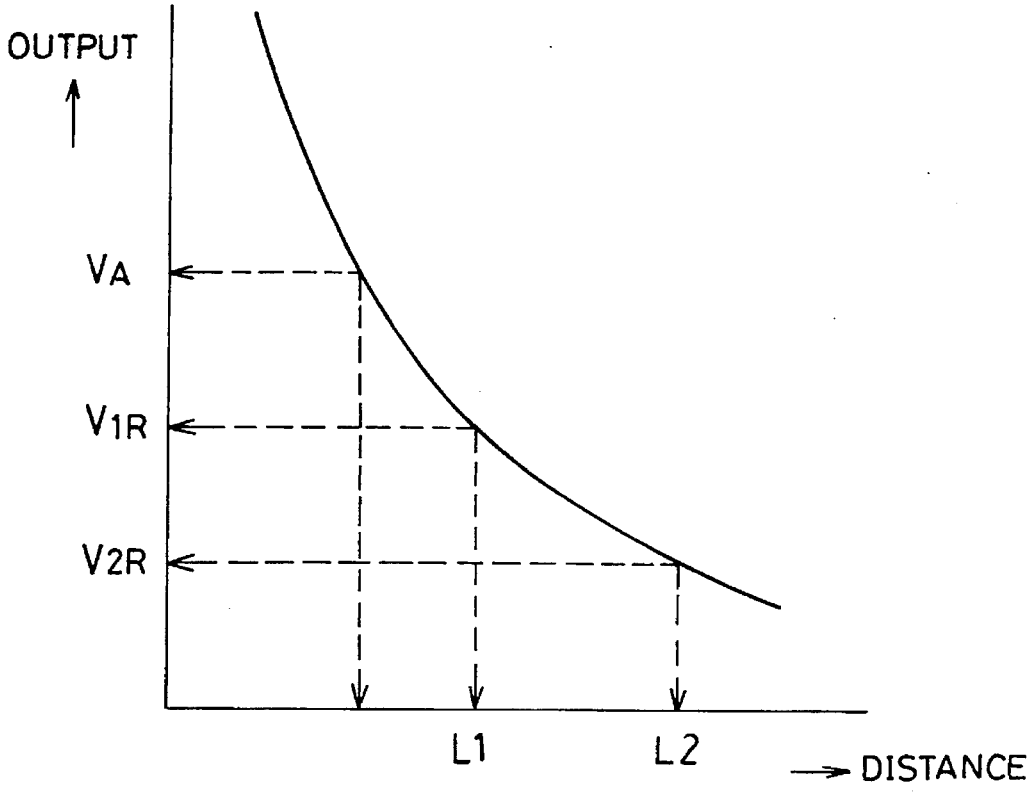
FIG. 25 is a graph showing a relationship between a measured value and reference values.
Figure 26:
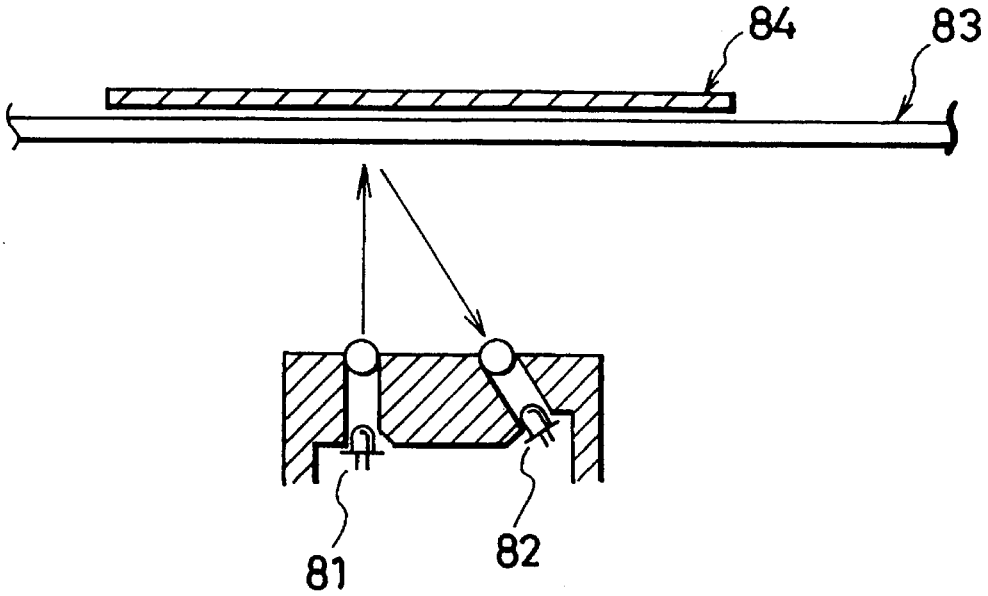
FIG. 26 PRIOR ART
FIG. 26 is a schematic view showing one structural example of a size sensor in a conventional prior art document-size detection system.
Figure 27:
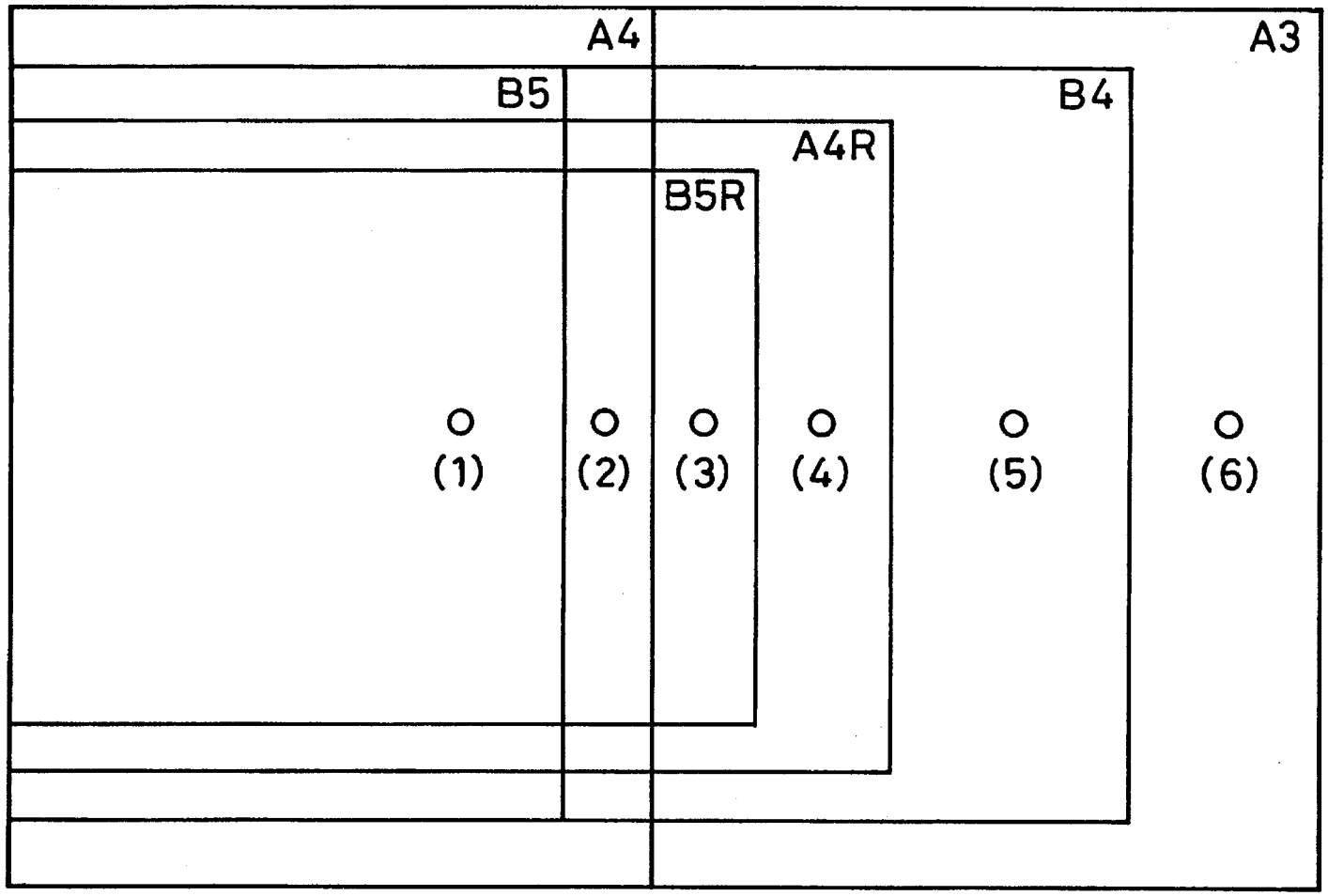
FIG. 27 PRIOR ART
FIG. 27 is a schematic illustration showing the installation positions of the size sensors of the prior art of FIG. 26.

Referring to FIGS. 22 and 25, the following description will discuss still another embodiment of the present invention. Here, for convenience of explanation, those members that have the same functions and that are described in the aforementioned embodiments with reference to the drawings thereof are indicated by the same reference numerals and the description thereof is omitted.

As illustrated in FIG. 22, a document reader that is provided with a document-size detection system of the present embodiment has virtually the same structure as that described in embodiment 5. The document reader is constituted of a document platen 12 whereon an original 11 is placed, a cover 58, an exposure section 13, an optical system 14, size sensors 15, and size decision circuit 60.

A resin sheet (not shown) having a light-scattering property similar to that of paper material is affixed to the lower surface of the cover 58. The reason that the resin sheet is affixed thereto is because it makes the optical system 14 as well as the size sensors recognize as if there were an original when the cover 58 is closed even in the case where there is no original placed thereon.

The document-size detection system is constituted of: a plurality of size sensors 15*a* through 15*c* for detecting the presence or absence of an original at a plurality of sensing positions; and a size decision circuit 60 for identifying the size of the original 11 according to signals released from the size sensors 15*a* through 15*c*. Each of the size sensors 15*a* through 15*c* has the same structure as that described in embodiment 1, and those sensors 15*a* through 15*c* are installed at positions, for example, shown in FIG. 9.

The light-receiving element 33, which receives a reflected beam that is derived from a light beam reflected off the original 11 after having been emitted from the light-emitting element 32, is constituted of a PSD wherein the ratio of a pair of currents $I_1$ and $I_2$ varies in response to a change in the spot position of the reflected beam. With this arrangement, the presence or absence of the original 11 is detected in a manner like conducting distance measurements even if the reflection factor changes depending on the color of the original 11, thereby increasing the detection accuracy. Further, even in the case where an object other than the original 11 is placed on the document platen 12, since the PSD is employed as the light-receiving element 33, the presence or absence of the object is detected regardless of quality of its material.

The signal processing circuit 35 employed here, which releases a resulting measurement $V_O$ in response to the output signal from the light-receiving element 33, is the same as that shown in FIG. 4 or FIG. 11.

The size decision circuit 60 is provided with commonly used microcomputer chips or other devices wherein a CPU, a ROM and a RAM are employed. The size decision circuit 60 is constituted of a storage section 62, a comparison section 64, a decision section 65 and a control circuit 66. The storage section 62, which stores reference data Dtp1–Dtp3 in the presence of the original for forming a reference for decision in the presence the original as well as reference data Dtn1–Dtn3 in the absence of the original for forming a reference for decision in the absence of the original, is provided with an EEPROM (Electric Erasable Programmable Read Only Memory). The reference data Dtp1–Dtp3 and Dtn 1–Dtn3 are respectively stored in the storage section 62 in an adjusting process conducted before shipment or other occasions.

More specifically, the reference data Dtp1–Dtp3 in the presence of the original are resulting measurements received by the light-receiving elements 33, which are obtained by receiving beams that are derived from light beams reflected off the cover 58 after having been emitted by the light-emitting elements 32 in the size sensors 15*a* through 15*c* with the cover 58 closed. The reference data Dtn1–Dtn3 in the absence of the original are resulting measurements received by the light-receiving elements 33, which are obtained by receiving beams that are derived from light beams reflected off the cover 58 after having been emitted by the light-emitting elements 32 with the cover 58 opened. Measuring and storing operations of the reference data Dtp1–Dtp3 and Dtn1–Dtn3 are carried out through the control provided by the control circuit 66.

Additionally, the reference data Dtp1–Dtp3 in the presence of the original are referred to as "output signal data of the light-receiving element 33 in the presence of an original" and the reference data Dtn1–Dtn3 in the absence of the original are referred to as "output signal data of the light-receiving element 33 in the absence of an original". Here, in an actual operation, since the resin sheet having a light-scattering property similar to that of paper material is affixed to the lower surface of the cover 58, the light-receiving element 33 recognizes as if there were an original because of the reflected beam from the resin sheet even if there is no original placed thereon when the cover 58 is actually closed. Therefore, whether or not an original is actually placed, the resulting measurements $V_O$ in the case of closing the cover 58 are simply stored as the data Dtp1–Dtp 3 in the presence of the original.

Storing area 62*a*–62*c* in the storage section 62, wherein the reference data Dtp1–Dtp3 and Dtn1–Dtn3 are stored, are individually provided as many as the number of the size sensors 15*a*–15*c*. This makes it possible to store the reference data Dtp1–Dtp3 and Dtn1–Dtn3 individually corresponding to the respective size sensors 15*a*–15*c*.

At the time when the cover 58 is inclined to a predetermined angle, the comparison section 64 reads the reference data Dtp1–Dtp3 in the presence of the original as well as the reference data Dtn1–Dtn3 in the absence of the original that have been stored in the storage section 62, and compares each of the reference data Dtp1 Dtp3 and the reference data Dtn1–Dtn3 with the resulting measurement $V_O$ of the size sensors 15*a*–15*c*. This comparing operation is carried out with respect to each of a plurality of the size sensors 15*a*–15*c*.

When the result of comparison in the comparison section 64 shows that "the difference between a newly obtained resulting measurement $V_O$ in one of the size sensors 15*a* through 15*c* and the corresponding one of the reference data Dtp1–Dtp3 in the presence of the original falls in a predetermined permissible range", the decision section 65 makes a decision that "there is an original 11" at the sensing position of the relevant one of the size sensors 15*a* through 15*c*. In contrast, when the result of comparison in the comparison section 64 shows that "the difference between a newly obtained resulting measurement $V_O$ in one of the size sensors 15*a* through 15*c* and the corresponding one of the reference data Dtn1–Dtn3 in the absence of the original falls in a predetermined permissible range", the decision section 65 makes a decision that "there is no original 11" at the sensing position of the relevant one of the size sensors 15*a* through 15*c*.

This decision is made with respect to each of these size sensors 15*a*–15*c* and the size of the original 11 is detected through the combination of the presence and absence of the original 11 at the respective predetermined positions.

The control circuit 66 controls the driving operations of circuits 35 and 37 of each of the size sensors 15*a*–15*c* the comparison section 64, the decision section 65, etc. in accordance with inputs such as mode switching signals ($J_1$ and $J_2$) that are released from the operation section of the document reader.

Here, the mode switching signals ($J_1$ and $J_2$) are binary 2-bit signals, each of which makes a selection between "0" and "1" in each element. These signals are used for specifying whether the resulting measurement detected by the light-receiving element 33 is compared in the comparison section 64, or whether it is stored as the reference data Dtp1–Dtp3 and Dtn1–Dtn3, or as which data it is stored between the reference data Dtp1–Dtp3 in the presence of the original and the reference data Dtn1–Dtn3 in the absence of the original. The combinations of the occasions are set, for example, as shown in Table 3.

TABLE 3

| | $J_1$ | |
|---|---|---|
| | 1 | 0 |
| $J_2$ | | |
| 1 | Reference Data (with Original) Stored in EEPROM | Reference Data (without Original) Stored in EEPROM |
| 2 | Document Size Detection Mode | Document Size Detection Mode |

The mode switching signals J1 and J2 are inputted in any desired timing that is specified by the operator. Therefore, the reference data Dtp1–Dtp3 in the presence of the original and the reference data Dtn1–Dtn3 in the absence of the original which have been stored in the storage section 62 can be updated any time.

In the above arrangement, first, in the adjusting processes before shipment or on other occasions, J1="0" and J2="1" are inputted in the control circuit 66 with the cover 58 closed. Then, a light beam is released from each light-emitting element 32 of the size sensors 15*a*–15*c*, and the beam reflected off the cover 58 is received by the light-receiving element 33. Thus, a resulting measurement in question is stored in the storage section 62 as one of the reference data Dtp1–Dtp3 in the presence of the original.

Further, with the cover 58 opened, J1="1 " and J2="0" are inputted in the control circuit 66. Then, a light beam is released from each light-emitting element 32, and the beam reflected off the cover 58 is received by the light-receiving element 33. Thus, a resulting measurement in question is stored in the storage section 62 as one of the reference data Dtn1–Dtn3 in the absence of the original.

In these processes, the reference data Dtp1–Dtp3 and Dtn1–Dtn3 are individually measured concerning the respective size sensors 15*a*–15*c* , and these data are stored in a plurality of storing areas 62*a*–62*c* in the storage section 62. After storing the data in the storage section 62, J2="0" is inputted in the control circuit 66.

Next, the cover 58 is opened, and an original 11 is placed on the document platen 12. Then, the original 11 is held on the document platen 12 by closing the cover 58. As in the aforementioned embodiment 5, the size sensors 15*a*–15*c* carry out the detecting operation at the time when the cover 58 is inclined to a predetermined angle, for example, immediately before the cover 58 is closed. The inclined state of the cover 58 is detected by an inclined-state detection means, not shown.

In this case, if the original 11 is located at the predetermined sensing positions of the size sensors 15*a*–15*c*, the light beam emitted from the light-emitting element 32 is reflected off the original 11 and the reflected beam is directed to the light-receiving element 33, and the output signal from the light-receiving element 33 is detected by the signal processing circuit 35. Then, the signal processing circuit 35 sends the resulting measurement $V_O$ to the control circuit 66. Here, the light beam emitted from the light-emitting element 32 is derived from pulse light-emitting that is controlled in time-wise division. The data corresponding to the position in question derived from the reflected beam that is received by the light-receiving element 33 are A/D converted into digital data.

In contrast, if there is no original 11 located at the sensing positions of the size sensors 15*a*–15*c*, the light beam emitted from the light-emitting element 32 passes through the document platen 12, and proceeds upward. However, a small amount of light consisting of scattered light and light reflected off the glass surface of the document platen 12 is directed to the light-receiving element 33. Thus, the signal processing circuit 35 sends an output signal derived from the small amount of light that is received by the light-receiving element 33 to the control circuit 66 as the resulting measurement $V_O$.

In this case, although the reflection factor of light tends to change depending on colors of the original 11, the presence or absence of the original 11 can be detected as a ratio of the pair of electric currents that vary according to positions of light spots by using the PSD for detecting the position of the spot of the reflected beam. Since the ratio of the pair of electric currents does not vary even if the reflection factor of light on the document decreases, the detection accuracy is improved in comparison with an arrangement wherein merely the amount of light is detected.

These detecting operations are carried out on each of the size sensors 15*a*–15*c* immediately before the cover 58 is closed with an original 11 placed on the document platen 12, that is, when the cover 58 is inclined to the predetermined angle.

Then, the control circuit 66 sends to the comparison section 64 a new resulting measurement $V_O$ obtained in each of the size sensors 15*a*–15*c* in the signal processing circuit 35. The comparison section 64 compares the resulting measurement $V_O$ with each of the reference data Dtp1–Dtp3 in the presence of the original and the reference data Dtn1–Dtn3 in the absence of the original with respect to each of the size sensors 15*a*–15*c*.

In accordance with the result of comparison made in the comparison section 64, the decision section 65 makes a decision as to the present or absence of the original at the disposed positions of the size sensors 15*a*–15*c* , and further makes a decision on the size of the document 11.

Then, as shown in Table 4, information containing the decisions is sent to other operational mechanisms that have functions concerning the reduction rate and the support of the data area of the document reader.

TABLE 4

| | $V_1$ | |
|---|---|---|
| | 1 | 0 |
| $V_2$ | | |
| 1 | Original 1 Present<br>Original 2 Present | Original 1 Present<br>Original 2 Absent |
| 0 | Original 1 Absent<br>Original 2 Present | Original 1 Absent<br>Original 2 Absent |

In other words, for example, assuming that there are only the first size sensor 15*a* and the second size sensor 15*b*, if both of these sensors detect the original 11, (V1, V2)=(1, 1) holds. If the first size sensor 15*a* detects the original 11 whereas the second size sensor 15*b* does not detect the original 11, (V1, V2)=(0, 1) holds. If the first size sensor 15*a* does not detect the original 11 whereas the second size sensor 15*b* detects the original 11, (V1, V2)=(1, 0) holds. Neither the first size sensor 15*a* nor the second size sensor 15*b* detects the original 11, the signal representing (V1, V2)=(1, 0) is released. In addition to these, the outputs concerning results of the detections made in the third size sensor 15*c* are provided.

Thereafter, the original 11 is exposed from under the document platen 12 by the use of the exposure section 13, and the light beam emitted from the exposure section 13 and reflected off the original 11 on the document platen 12 is read by the reading section 14.

As described above, by employing the PSD as the light-receiving element 33, the variation of the spot position of received light can be detected as the variation of the ratio of a pair of electric currents; therefore, the presence or absence of the original, or the size of the original, is accurately detected without being affected by the color (reflection factor) of the original in comparison with a conventional method which merely detects and compares the amount of light.

Further, the size of an original is detected by comparing the resulting measurements $V_O$ with the reference data Dtp1–Dtp3 as well as with the reference data Dtn1–Dtn3 so as to make a decision; thereby making it possible to eliminate the necessity of taking into account variations in the characteristics of the light-emitting element 32 and the light-receiving element 33.

Here, when no original 11 is placed on the document platen 12, the resulting measurement in the light-receiving element 33 varies depending on installation positions of the sensors 15*a* through 15*b*. Therefore, in the case where the level $V_A$ of the reference data Dtp1 in the presence of the original is set constant, upon making a comparison between the resulting measurement $V_O$ and the reference data Dtp1 in the presence of the original, if the comparison is made too strictly, erroneous decision may be made.

Figure 23:
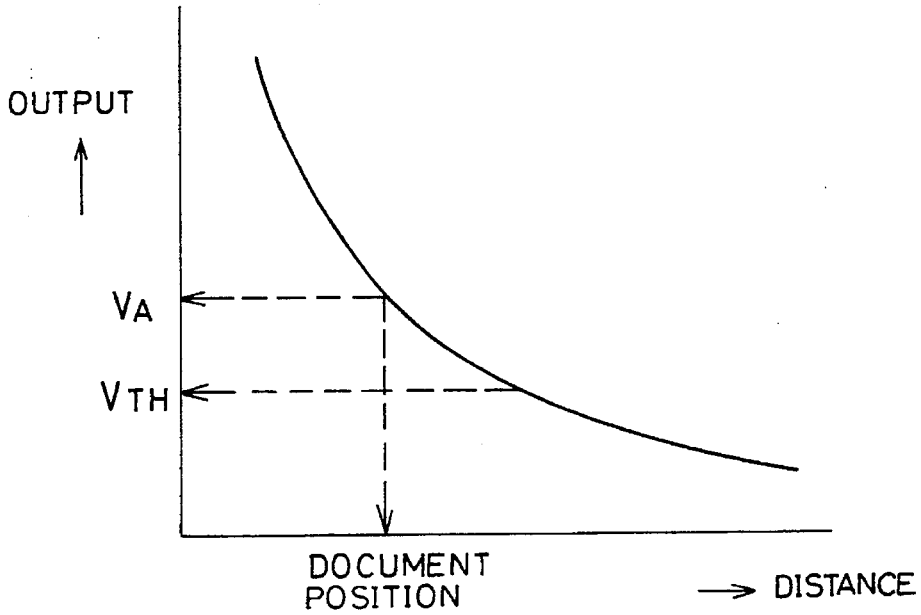
FIG. 23 is a graph showing a relationship between a measured reference value and the threshold level.

For this reason, as illustrated in FIG. 23, the threshold level $V_{TH}$ used in making the decision needs to be set at a value that is a certain amount apart from the reference data Dtp1 in the presence of the original so as to make room for the decision. In the above arrangement, however, when signal/noise ratios (hereinafter, referred to as S/N ratio) of the respective sensors 15*a* through 15*c* are taken into consideration, the threshold level $V_{TH}$, which is set at a constant value as described above, is not necessarily optimal in all the sensors 15*a* through 15*c*.

Figure 24:
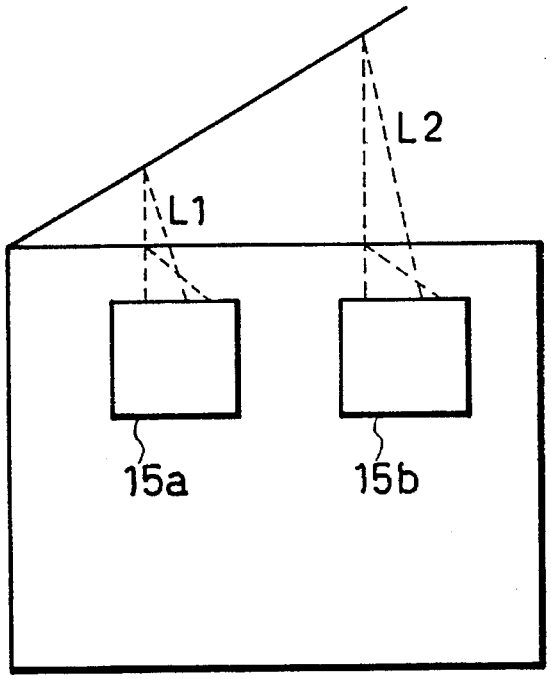
FIG. 24 is a schematic illustration showing a relationship of distance between two size-sensors and an original cover.

Here, an explanation will be given of the above arrangement with reference to FIG. 24 using the first sensor 15*a* and the second sensor 15*b*, which are located at two different detection positions. In the case where distances L1 and L2 between the respective sensors 15*a* and 15*b* and the cover 58 are different from each other, suppose that $V_A$ represents a detection level in the presence of the original; $V1_R$ represents a detection level in the absence of the original of the first sensor 15*a*; and $V2_R$ represents a detection level in the absence of the original of the second sensor 15*b*, the optimum values of the threshold level $V_{TH}$ in the presence or absence of the original are given as respective different values, that is, $(V_A+V1_R)/2$ for the first sensor 15*a* and $(V_A+V2_R)/2$ for the second sensor 15*b*. Therefore, if the threshold level $V_{TH}$ is set at a constant value, S/N ratios may vary depending on the respective sensors, and this results in variations in accuracy.

For this reason, in the document-size detection system of the present embodiment a plurality of storing areas 62*a* through 62*c* are provided in the storage section 62 in accordance with the number of the size sensors 15*a* through 15*c*. Further, in adjusting processes conducted before shipment or other occasions, measurements are conducted on individual sensors 15*a* through 15*c* in both of the states where the cover 58 is closed and opened. Thus, for the respective size sensors 15*a* through 15*c*, the resulting measurements $V_O$ are stored in the respectively different storing areas 62*a* through 62*c* of the storage section 62 as the reference data Dtp1–Dtp3 in the presence of the original and the reference data Dtn1–Dtn3 in the absence of the original. Upon detecting the size of an original 11 placed on the document platen 12, the respective resulting measurements $V_O$ of the size sensors 15*a* through 15*c* are compared with the respectively different reference data Dtp1–Dtp3 as well as Dtn1–Dtn3. In this manner, the reference data Dtp1–Dtp3 in the presence of the original and the reference data Dtn1–Dtn3 in the absence of the original for use in comparison reference are respectively determined in both of the cases in the presence and absence of the original. Compared with the case like the aforementioned embodiment 5 where only the reference data Dtp1 in the presence of the original is set, this arrangement makes it possible to improve accuracy in comparison.

Moreover, since a plurality of storing areas in the storage section 62 for storing the reference data Dtp1–Dtp3 and Dtn1–Dtn3 are provided in accordance with the number of the size sensors 15*a* through 15*c*, comparisons are made in the comparison section 64 by using the reference data Dtp1–Dtp3 and Dtn1–Dtn3 that are differently determined concerning each of the size sensors 15*a*–15*c*. Therefore, optimum threshold levels in the presence or absence of the original are given for the individual size sensors 15*a* through 15*c*, thereby making it possible to reduce misoperation in detecting the presence or absence of the original.

Since the EEPROM is employed as the storage section 62, the stored data are erased and rewritten by applying an erasing current to the EEPROM when it is necessary to update the reference data Dtp1–Dtp3 in the presence of the original and the reference data Dtn1–Dtn3 in the absence of the original in order to cope with changes in service conditions.

Additionally, the installation positions of the size sensors 15 are not limited to those shown in FIG. 9; they may be located at positions, for example, as illustrated in FIG. 14, or may be located at other positions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A document-size detection system for use in a document reader comprising:

light-emitting means for emitting light beams and projecting the light beams to a plurality of predetermined sensing positions on a document platen;

light-receiving means for receiving a reflected beam derived from the light beams reflected off the sensing positions and for releasing two detection signals upon receipt of the reflected light from each sensing position in which a ratio of said detection signals vary depending on the sensing positions; and signal processing means for detecting the presence or absence of an original at the sensing position according to a ratio of the detection signals.

2. The document-size detection system as defined in claim 1, wherein the light axis of the light-emitting means is inclined with respect to the document platen so as to minimize the effect of mirror reflection light that occurs on the document platen.

3. The document-size detection system as defined in claim 2, wherein the light axis of the light-emitting means is inclined to the opposite side of the light-receiving means with respect to the document platen.

4. The document-size detection system as defined in claim 2, wherein the light axis of the light-emitting means is inclined in a direction that is orthogonal to a line passing through the centers of the light-emitting means and the light-receiving means.

5. The document-size detection system as defined in claim 1, wherein the light-receiving means includes a position sensitive detector and the ratio of the detection signals indirectly represents a distance between the original and the position sensitive detector.

6. The document-size detection system as defined in claim 1, wherein the light-receiving means releases two detection currents whose intensities correlatively vary depending on the light-receipt position of the reflected beam and wherein the signal processing means includes conversion means for converting the detection currents into respective voltages, subtraction means for finding a subtraction between the voltages and addition means for finding an addition between the voltages, thereby detecting the presence or absence of an original based on a ratio of the subtraction and the addition.

7. The document-size detection system as defined in claim 1, wherein the light-receiving means includes level detection means for detecting levels of the detection signals and wherein the light-emitting means includes light-amount control means for controlling the amount of the light beam in a best-suited manner according to the detection results of the level detection means.

8. A document-size detection system for use in a document reader comprising:

light-emitting means for projecting a light beam onto a sensing region that is separated by a peripheral edge of an original having a predetermined size on a document platen;

light-receiving means for receiving a reflected beam derived from the light beam reflected off the sensing region and for detecting a light-receipt position of the reflected beam on the light-receiving means; and signal processing means for comparing an output of the light-receiving means with reference data the reference data including reference datum associated with a reflected beam from the original corresponding to the entire area of the sensing region, that associated with a reflected beam from the original corresponding to a part of the area and that associated with no reflected beam, so as to detect a placed state of the original at the sensing region.

9. The document-size detection system as defined in claim 8, wherein the signal processing means includes storage means for storing the reference data and comparison means for comparing the output of the light-receiving means with the reference data.

10. The document-size detection system as defined in claim 8, wherein the light-receiving means includes a light-receiving element for releasing a plurality of detection signals that correlatively vary depending on a light-receipt position and wherein the signal processing means includes a signal processing circuit for detecting the placed state of the original at the sensing region according to a ratio of the detection signals.

11. The document-size detection system as defined in claim 10, wherein the signal processing means includes storage means for storing the reference data and comparison means for comparing a ratio of the detection signals with the reference data.

12. A document-size detection system for use in a document reader comprising:

light-emitting means for emitting light beams and projecting light beams to a plurality of predetermined sensing positions on a document platen;

light-receiving means whose viewing angle is set so as to receive a plurality of reflected beams, each derived from a light beam that has been reflected off each of the plurality of sensing positions, the light-receiving means for releasing two detection signals upon receipt of the reflected light beams, in which a ratio of said detection signals vary depending on the sensing positions;

signal processing means for detecting the presence or absence of an original at each of the sensing positions according to outputs from the light-receiving means; and wherein the signal processing means includes a signal processing circuit for detecting the presence or absence of the original at the sensing position according to the ratio of the detection signals.

13. The document-size detection system as defined in claim 12, wherein the light-receiving means includes a light-receiving lens whose viewing angle is set wide by adjusting the curvature of the surface thereof.

14. The document-size detection system as defined in claim 12, wherein the light-emitting means has the viewing angle thereof arranged so that light beams are simultaneously projected onto a plurality of sensing positions.

15. The document-size detection system as defined in claim 14, wherein the light-emitting means includes irradiation lens whose viewing angle is set wide by adjusting the curvature of the surface thereof.

16. The document-size detection system as defined in claim 12, wherein the light-emitting means includes a light-emitting element for emitting the light beam and time-series changing means for changing the irradiation angle of the light beam of the light-emitting element so as to simultaneously project the light beam onto a plurality of sensing positions in accordance with a time series.

17. The document-size detection system as defined in claim 16, wherein the time-series changing means includes inclined movement means for inclinedly moving the light-emitting element in accordance with the time series.

18. The document-size detection system as defined in claim 17, wherein the inclined movement means includes pivotal movement means for pivotally moving the light-emitting element.

19. The document-size detection system as defined in claim 16, wherein the time-series changing means includes switching means for allowing a plurality of light-emitting elements to successively emit a light beam.

20. The document-size detection system as defined in claim 16, further comprising:

size decision means for identifying the size of an original based on the detection results of the signal processing means, wherein a reading operation on the detection results in the size decision means is carried out in synchronism with an operation of the time-series changing means.

21. The document-size detection system as defined in claim 12, further comprising:

size decision means for identifying the size of an original based on the detection results of the signal processing means.

22. The document-size detection system as defined in claim 12, further comprising:

inclined-state detection means for detecting an inclined state of an original cover with a predetermined angle, the original cover being supported to the document platen so as to be freely opened and closed, wherein the size decision means activates the light-emitting means and the signal processing means when the inclined-state detection means detects the inclined state.

23. A document-size detection system for use in a document reader comprising:

a material having a light-scattering property that is affixed on the lower surface of an original cover that is freely opened and closed with respect to a document platen;

a size sensor for projecting a light beam onto a predetermined sensing position on the document platen and receiving a reflected beam derived from the light beam that has been reflected off the sensing position, and for detecting a light-receipt position of the reflected beam on the size sensor;

size decision means for detecting the presence or absence of an original at the sensing position and identifying the size of the original by comparing a result measurement, which is released by the size sensor with the original placed on the document platen, with reference datum in the presence of the original and for updating the reference datum in the presence of the original at a desired timing in accordance with an output released from the size sensor upon receipt of a reflected beam from the material having the light-scattering property with the original cover closed;

closed-state detection means for detecting a closed state of an original cover;

wherein the size decision means includes control means for allowing the size decision means to read the reference datum in the presence of the original by activating the size sensor when the closed-state detection means detects the closed state; and inclined-state detection means for detecting an inclined state of the original cover, the closed-state detection means being arranged to detect the closed state of the original cover by utilizing the detection result of the inclined-state detection means.

24. The document-size detection system as defined in claim 23, wherein the size sensor includes:

light-emitting means for emitting a light beam, light-receiving means for releasing a plurality of detection signals that correlatively vary depending on the light-receipt position, and signal processing means for releasing the reference datum in the presence of the original and the resulting measurement as a ratio of the detection signals.

25. The document-size detection system as defined in claim 23, wherein the size decision means includes:

storage means for storing the reference data in the presence of the original;

comparison means for comparing the resulting measurement with the reference datum in the presence of the original; and decision section for identifying the size of the original by detecting the presence or absence of the original at the sensing position based on the comparison result made in the comparison means.

26. The document-size detection system as defined in claim 25, wherein the size decision means includes data updating means for updating the reference data in the presence of the original stored in the storage means.

27. The document-size detection system as defined in claim 23, further comprising:

inclined-state detection means for detecting an inclined state of an original cover with a predetermined angle, wherein the size decision means includes control means for allowing the size decision means to read the resulting measurement by activating the size sensor when the inclined-state detection means detects the inclined state.

28. The document-size detection system as defined in claim 27, wherein the inclined state is a state immediately before the original cover is closed over the document platen.

29. The document-size detection system as defined in claim 27, wherein the size decision means includes control means for activating the size sensor upon turning on the document reader so as to store the output of the size sensor in question in the storage means as a reference datum in the presence of the original.

30. The document-size detection system as defined in claim 23, wherein the size sensor includes:

light-receiving means for receiving the reflected beam and for detecting a light-receipt position of the reflected beam on the light-receiving means, the closed-state detection means being arranged to detect the closed state of the original cover by utilizing the detection result of the light-receiving means.

31. A document-size detection system for use in a document reader comprising:

a size sensor for projecting a light beam onto a predetermined sensing position on a document platen and receiving a reflected beam derived from the light beam that has been reflected off the sensing position, and for detecting a light-receipt position of the reflected beam on the size sensor;

size decision means for detecting the presence or absence of an original at each of the sensing positions and identifying the size of the original by comparing each resulting measurement, which is released by each of the size sensors associated with the respective sensing positions with the original placed on the document platen, with the reference datum in the presence of the original and the reference datum in the absence of the original that are set for each of the sensing positions;

wherein the size decision means includes:

control means for switching between modes, that is, a read-in mode for the reference data in the presence of the original, a read-in mode for the reference data in the absence of the original and a document-size detection mode for reading in the resulting measurements, according to a mode switching signal entered in the document reader.

32. The document-size detection system as defined in claim 31, further comprising:

a material having a light-scattering property that is affixed on the lower surface of an original cover that is freely opened and closed with respect to the document platen;

wherein the reference datum in the presence of the original is an output of the size sensor that is obtained by receiving a reflected beam from the material having a light-scattering property with the original cover closed and the reference datum in the absence of the original is an output of the size sensor that is obtained with the original cover open.

33. The document-size detection system as defined in claim 31, wherein the size sensor includes:

light-emitting means for emitting a light beam, light-receiving means for releasing a plurality of detection signals that correlatively vary depending on the light-receipt position, and signal processing means for releasing the reference data in the presence of the original, the reference data in the absence of the original and the resulting measurements as respective ratios of the detection signals.

34. The document-size detection system as defined in claim 31, wherein the size decision means includes:

storage means for storing the reference data in the presence of the original and the reference data in the absence of the original with respect to each sensing position;

comparison means for comparing the resulting measurements with the reference data in the presence of the original and with the reference data in the presence of the original with respect to each sensing position; and decision section for identifying the size of the original by detecting the presence or absence of the original at the sensing positions based on the comparison results made in the comparison means.

35. The document-size detection system as defined in claim 34, wherein the storage means includes storing areas that are provided as many as the number of the sensing positions.

36. The document-size detection system as defined in claim 34, wherein the storage means includes an electric erasable programmable read only memory.

37. A document-size detection system for use in a document reader comprising:

a size sensor for projecting a light beam onto a predetermined sensing position on a document platen and receiving a reflected beam derived from the light beam that has been reflected off the sensing position, and for detecting a light-receipt position of the reflected beam on the size sensor;

size decision means for detecting the presence or absence of an original at each of the sensing positions and identifying the size of the original by comparing each resulting measurement, which is released by each of the size sensors associated with the respective sensing positions with the original placed on the document platen, with the reference datum in the presence of the original and the reference datum in the absence of the original that are set for each of the sensing positions; and wherein the size sensor conducts a pulse light-emitting that is controlled in time-wise division, and releases digital data that are converted from analog to digital according to the light-receipt position and wherein the size decision means releases a signal of two bits in accordance with the detection result on the presence or absence of the original.

38. A method for detecting the presence or absence of an original used in a document-size detection system of a document reader comprising the steps of:

emitting light beams by use of a light means and projecting the light beams to a plurality predetermined sensing positions on a document platen;

releasing two detection signals upon receipt of reflected light from each sensing position by the use of a light-receiving means, a ratio of the detection signals varying dependent on the sensing positions; and detecting the presence or absence of an original at the sensing positions according to the ratio of the detection signals.

39. A method for detecting the presence or absence of an original used in a document-size detection system of a document reader comprising the steps of:

projecting a light beam onto a sensing region that is separated by a peripheral edge of an original having a predetermined size on a document platen by the use of a light-emitting means;

receiving a reflected beam derived from the light beam reflected off the sensing region by the use of a light-receiving means;

detecting a light-receipt position of the reflected beam on the light-receiving means; and comparing an output of the light-receiving means with reference data, the reference data including reference datum associated with a reflected beam from the original corresponding to the entire area of the sensing region, that associated with a reflected beam from the original corresponding to a part of the area and that associated with no reflected beam; and detecting a placed state of the original at the sensing region.

40. A method for detecting the presence or absence of an original used in a document-size detection system of a document reader comprising the steps of:

emitting light beams by the use of light emitting means and projecting the light beams to a plurality of predetermined sensing positions on a document platen;

releasing two detection signals upon receipt of reflected light beams from each sensing position by use of a light receiving means with a viewing angle set to receive the reflected light beams, in which a ratio of said detection signals vary depending on the sensing positions; and detecting the presence or absence of an original at each of the sensing positions according to outputs from the light-receiving means, by use of a signal processing circuit of a signal processing means.

41. A method for detecting the size of an original used in a document-size detection system of a document reader comprising the steps of:

projecting a light beam onto a material having a light-scattering property that is affixed on a lower surface of an original cover that is freely opened and closed with respect to an document platen, with the original cover closed;

setting a reference datum in the presence of the original according to a reflected beam from the material having a light-scattering property;

projecting a light beam onto a predetermined sensing position with an original placed on the document platen and releasing a resulting measurement on the presence or absence of the original according to a reflected beam derived from the light beam reflected off the sensing position;

comparing the resulting measurement with the reference datum in the presence of the original;

detecting the presence or absence of the original at the sensing position based on the comparison result;

identifying the size of the original based on the detection result on the presence or absence of the original; detecting a closed state of an original cover reading the reference datum by means of a size decision means that includes control means by activating a size sensor when the closed state is detected;

detecting an inclined state of the original cover by use of an inclined state detection means; and detecting the closed state of the original cover by utilizing a detection result of inclined state detection means.

42. A method for detecting the size of an original used in a document-size detection system of a document reader comprising the steps of:

projecting light beams onto predetermined sensing positions with an original placed on a document platen and releasing resulting measurements on the presence or absence of the original according to reflected beams derived from the respective light beams reflected off the sensing positions;

comparing each of the resulting measurements with each reference datum in the presence of the original and with each reference datum in the absence of the original that are set for each of the sensing positions;

detecting the presence or absence of the original at each of the sensing positions based on the comparison result;

identifying the size of the original based on the detection results on the presence or absence of the original;

switching between modes which includes a read in mode for the reference datum in the presence of or absence of the original, and an original a document size detection mode for reading resultant measurements, according to a mode switching signal entered in a document reader.

* * * * *